US009378685B2

(12) United States Patent
Kang

(10) Patent No.: US 9,378,685 B2
(45) Date of Patent: Jun. 28, 2016

(54) ARTIFACT MITIGATION METHOD AND APPARATUS FOR IMAGES GENERATED USING THREE DIMENSIONAL COLOR SYNTHESIS

(75) Inventor: Michael Kang, North Vancouver (CA)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 1031 days.

(21) Appl. No.: 12/719,689

(22) Filed: Mar. 8, 2010

(65) Prior Publication Data

US 2010/0231603 A1 Sep. 16, 2010

Related U.S. Application Data

(60) Provisional application No. 61/160,042, filed on Mar. 13, 2009.

(51) Int. Cl.
*G09G 5/00* (2006.01)
*G09G 3/34* (2006.01)

(52) U.S. Cl.
CPC ..... *G09G 3/3426* (2013.01); *G09G 2300/023* (2013.01); *G09G 2300/0452* (2013.01); *G09G 2320/0646* (2013.01); *G09G 2320/0666* (2013.01); *G09G 2360/16* (2013.01)

(58) Field of Classification Search
CPC ..... G09G 2300/023; G09G 2300/0452; G09G 2320/0646; G09G 2320/0666; G09G 2360/16; G09G 3/3426
USPC ..... 345/87, 581, 591, 603, 690, 694; 348/744
See application file for complete search history.

(56) References Cited

U.S. PATENT DOCUMENTS

2003/0052836 A1* 3/2003 Matsumoto et al. ..... 345/6
2003/0160760 A1* 8/2003 Takakura ..... H04N 1/3876 345/158
2006/0066554 A1 3/2006 Baba et al.
2006/0251322 A1 11/2006 Palum et al.
2008/0043303 A1* 2/2008 Whitehead et al. ..... 359/19
2008/0129678 A1* 6/2008 Choi et al. ..... 345/102
2009/0141488 A1 6/2009 Silverstein
2009/0201320 A1* 8/2009 Damberg ..... G09G 3/3426 345/694

FOREIGN PATENT DOCUMENTS

WO WO2006/066418 6/2006

* cited by examiner

*Primary Examiner* — Kumar Patel
*Assistant Examiner* — Insa Sadio

(57) ABSTRACT

Embodiments of the invention relate generally to generating images, and more particularly, to systems, apparatuses, integrated circuits, computer-readable media, and methods to facilitate the use of three dimensional color synthesis techniques to reproduce colors properly using, for example, two sub-pixel mosaics, at a boundary between two colors. A method can include receiving into a color element a first colored illuminant and a second colored illuminant. The method also can include determining that the color element is configured to generate a color that has one or more color characteristics for a portion of the reproduced image. Further, the method can include modifying at least one of the first colored illuminant and the second colored illuminant to adjust the one or more color characteristics into a range of values associated with a portion of an image that corresponds to the portion of the reproduced image.

22 Claims, 16 Drawing Sheets

300

BOUNDARY EXAMPLES

| 302 Pixel Mosaic | 304 Color Competition | 306 Examples |
|---|---|---|
| Cyan/Magenta | Blue v. Non-Blue | Cyan v. Green<br>Blue v. Yellow |
| Green/Magenta | Blue v. Non-Blue<br>Red v. Non-Red | Magenta v. Cyan<br>Blue v. Yellow<br>Red v. Blue |
| Red/Cyan | Blue v. Non-Blue<br>Green v. Non- Green | Cyan v. Green<br>Magenta v. Cyan<br>Green v. Red |

FIG. 3

| 2 SUB-PIXEL ELEMENT (e.g., Sub-Pixel 1/ Sub-Pixel 2) | Light Patterns (SPD 1 /SPD 2) | Output Pixels |
|---|---|---|
| CYAN/MAGENTA | BLUE/YELLOW | BLUE/(RED+GREEN) |
| GREEN/MAGENTA | CYAN/YELLOW | (GREEN+BLUE)/ (GREEN+RED) |
| CYAN/YELLOW | GREEN/MAGENTA | GREEN/(RED+BLUE) |
| BLUE/YELLOW | CYAN/MAGENTA | (BLUE+GREEN)/ (BLUE+RED) |
| MAGENTA/YELLOW | RED/CYAN | RED/(BLUE+GREEN) |
| RED/CYAN | MAGENTA/YELLOW | (RED+BLUE)/ (GREEN+BLUE) |

FIG. 10

ARTIFACT MITIGATION METHOD AND APPARATUS FOR IMAGES GENERATED USING THREE DIMENSIONAL COLOR SYNTHESIS

CROSS REFERENCE TO RELATED APPLICATION

This application claims priority to U.S. Provisional Patent Application No. 61/160,042, filed Mar. 13, 2009, hereby incorporated by reference in its entirety.

FIELD

Embodiments of the invention relate generally to generating images, and more particularly, to systems, apparatuses, integrated circuits, computer-readable media, and methods to facilitate the use of three dimensional color synthesis techniques to reproduce colors properly using, for example, two sub-pixel mosaics, at a boundary between two colors.

BACKGROUND

Imaging technology can be implemented in projection and display devices to render imagery with a relatively wide range of brightness, where the range usually covers five orders of magnitude between the lowest and the highest luminance levels, with the variance in backlight luminance typically being more than, for example, about 5%, regardless whether the brightness of the display is not relatively high. In some approaches, image rendering devices employ a backlight unit to generate a low-resolution image that illuminates a display that provides variable transmissive structures for the pixels, which, in turn, generate high dynamic range ("HDR") images. An example of an HDR image rendering device is a display device that uses monochromatic light emitting diodes ("LEDs") (e.g., white-colored LEDs) as backlights and liquid crystal displays ("LCDs") for presenting the image. Few implementations have proposed using colored LEDs as backlights.

While functional, various conventional approaches have drawbacks in their implementation. In some approaches, liquid crystal displays, such as active matrix LCDs, can include a transistor and/or a capacitor for each sub-pixel, which can hinder transmission efficiencies of passing light through traditional pixels, which usually have three sub-pixel elements. In some other approaches, transitioning through different backlights or different backlight driving schemes may generate sub-images that have different colors, which may produce luminance differences. These luminance differences might be perceptible as flicker or color-break up, for example, with respect to a model compatible with the human visual system.

In view of the foregoing, it would be desirable to provide systems, computer-readable media, methods, integrated circuits, and apparatuses to facilitate color reproduction in high dynamic range imaging, among other things.

SUMMARY

Embodiments of the invention relate generally to generating images, and more particularly, to systems, apparatuses, integrated circuits, computer-readable media, and methods to facilitate the use of three dimensional color synthesis techniques to reproduce colors properly using, for example, two sub-pixel mosaics, at a boundary between multiple colors. A method can include receiving into a color element a first colored illuminant and a second colored illuminant. In some embodiments, there can be three or more colored illuminants.

The method also can include determining that the color element is configured to generate a color that has one or more color characteristics for a portion of the reproduced image. Further, the method can include modifying one or more colored light sources to adjust the one or more color characteristics into a range of values associated with a portion of an image that corresponds to the portion of the reproduced image.

BRIEF DESCRIPTION OF THE FIGURES

The invention and its various embodiments are more fully appreciated in connection with the following detailed description taken in conjunction with the accompanying drawings, in which:

FIG. 3 depicts examples of pixel mosaics and associated competing color pairs, according to some embodiments of the invention.

FIG. 10 depicts examples of synthesizing colors based on two sub-pixel color elements and two luminance or light patterns, according to at least some embodiments of the invention.

Like reference numerals refer to corresponding parts throughout the several views of the drawings. Note that most of the reference numerals include one or two left-most digits that generally identify the figure that first introduces that reference number.

DETAILED DESCRIPTION

Figure 1:
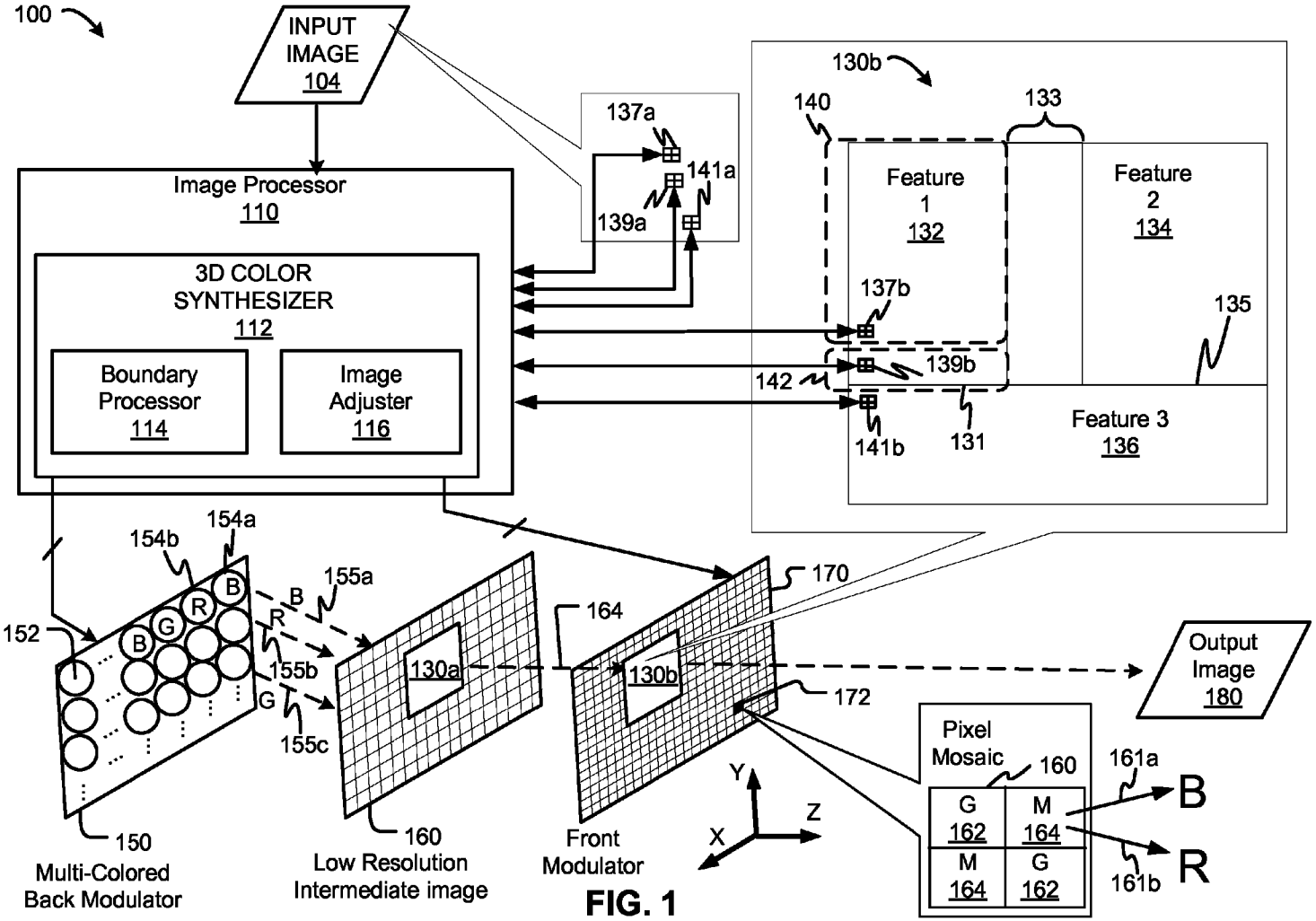
FIG. 1 is a diagram illustrating an example of an image generation apparatus that includes dual modulators configured to generate colors in accordance with three dimensional color synthesis techniques, according to at least some embodiments of the invention.

FIG. 1 is a diagram illustrating an example of an image generation apparatus that includes dual modulators configured to generate colors in accordance with three dimensional color synthesis techniques, according to at least some embodiments of the invention. Apparatus 100 can include an image processor 110, a back modulator 150, and a front modulator 170. In this example, image processor 110 is configured to receive an input image 104, and is further configured to control back modulator 150 and front modulator 170 to generate a reproduced image, such as an output image 180. Output image 180 can have an enhanced range of brightness levels (e.g., with levels associated with high dynamic ranges, or HDRs, of luminance). Back modulator 150 includes light sources 152 that can generate light patterns with multiple spectral distributions. In some embodiments, image processor 110 can be configured to generate light patterns with a red illuminant 155*c*, a blue illuminant 155*a*, and a green illuminant 155*b*. Front modulator 170 includes arrangements of color elements, an example of which includes an array of pixel mosaic elements 160. Pixel mosaic 160 includes two types of color elements, such as green ("G") color elements 162 and magenta ("M") color elements 164. Thus, blue illuminant 155*a*, red illuminant 155*b*, and green illuminant 155*c* can interact with green color elements 162 and magenta color elements 164 to produce the primary colors for pixel 172. In operation, image processor 110 controls green color elements 162 to modulate green illuminant 155*c*, whereas image processor 110 controls magenta color elements 164 to control blue illuminant 155*a* and red illuminant 155*b*. For some images, either one or both of subpixels 164 are positioned to lie in or substantially in an optical path 163 (e.g., in the Z-direction) to light sources 154*a* (i.e., a blue light source) and 154*b* (i.e., a red light source) such that a subpixel 164 can transmit simultaneously (or substantially simultaneously) portions of light patterns from lights sources 154*a* and 154*b*. Thus, blue ("B") illuminant 161*a* and red ("R") illuminant 161*b* can be transmitted concurrently to generate a color for a portion (e.g., a pixel) of reproduced image 180 that has one or more color characteristics. These color characteristics might cause pixel 172 to appear perceptibly different to the human visual system ("HVS") than, for example, the color of the corresponding pixel in input image 104. In at least one embodiment, image processor 110 is configured to at least modify either or both red illuminant 155*c* and blue illuminant 155*a* to adjust the one or more color characteristics into a range of values that match (e.g., perceptibly match) those of the corresponding pixel in input image 104.

In view of the foregoing, image processor 110 and at least some of its constituents can operate to synthesize color by, for example, using three-dimensional color synthesis techniques and/or structures while reducing the effects (i.e., the artifacts) of multiple illuminants that are received into one type of color element, such as color elements 164, which can transmit multiple illuminants. For example, consider that one or more sub-pixels of pixel 172 is not modulating one of the illuminants correctly (e.g., it is modulating correctly for a different illuminant and not a desired illuminant). Thus, the one or more sub-pixels of pixel 172 may produce a color that is different (e.g. perceptibly different) from either the corresponding pixel in input image 104 or a neighboring pixel that is configured to generate a color accurately (e.g., it is modulating for the desired illuminant such that the reproduced color corresponds to the color of a respective pixel in input image 104). Also, image processor 110 can be configured to identify which of color elements 162 and 164 is configured to transmit multiple illuminants for the pixels of reproduced image 180 to modify the operational characteristics of one or more of the light sources to reduce the effects of the multiple illuminants. In some embodiments, image processor 110 generates back modulator drive level signals that incorporate data for reducing or compensating for artifacts due to color fringing (or color pollution). Further, image processor 110 can identify which of color elements 162 and 164 that are associated with the generation of a relatively gradual fade or transition from one attribute value to another (e.g., one color value or luminance value to another), and can resolve an artifact related to a slow fade color transition. For example, image processor 110 can be configured to identify portions of an image that includes a slow fade and then can operate color elements 162 to preserve the slow fade in the output image. In some embodiments, image processor 110 operate to synthesize color by, for example, foregoing the use of temporal fields (the use of which is optional in some embodiments), thereby reducing or eliminating the frequency of luminance variations (e.g., over the surface of an array of color elements 162 and 164 and over time). Thus, apparatus 100 can mitigate or eliminate a degree of flicker and/or color breakup that otherwise might be present, for example, with the use of temporal fields transitioning among each other.

Image processor 110 can include a three dimensional color synthesizer ("3D CS") 112 configured to control the synthesis of color that takes place on 3 axis: the X and Y axes (i.e., the plane of the image of front modulator 170) using differently colored sub-pixels, and also the Z axis (e.g., using the multiple illuminants of backlight). "Three dimensional color synthesis" can refer to a color synthesis technique and/or structure in which a set of spectral distributions can be used to illuminate a number of color elements, whereby three primary colors can be generated by the interactions of the spectral distributions and the color elements.

Image processor 110 can further include a boundary processor 114 and an image adjuster 116. Boundary processor 114 can be configured to detect a boundary between at least two groups of color elements, each of the groups of color elements being configured to generate different image features (e.g., perceptibly different portions of reproduced image 180) with different values of an attribute. In some embodiments, boundary processor 114 also detects a change or transition of the attribute at (or substantially at) a boundary. As used herein, the term "attribute" can refer, at least in some embodiments, to a quality of an image feature of reproduced image 180, whereby a change in the quality can be perceived with respect to the human visual system. In some embodiments, the human visual system can be implemented as a computer-implemented model or process. Examples of an attribute include luminance, color, chromacity, contrast, spatial frequency, etc. In some embodiments, a boundary is detected as a function of, for example, a transition in color (and/or luminance). As such, subpixels located near or at the transition in color may receive multiple illuminants, and at least one of the illuminants might facilitate formation of a region in reproduced image 180. Subpixels in the region may be associated with one or more color characteristics that are outside of a range of values that coincide with values associated with imperceptible variations of color, and, as such, the light transmitted through the subpixels is detectible on the viewing side of a display as being associated with a different color (e.g., a perceptibly different color) and/or a different luminance than, for example, the pixels corresponding with input image 104. Boundary processor 114 determines boundaries as well as regions.

Image adjuster 116 can modify any of the illuminants (as well as the modulation of the transmissivities of the subpixels) to adjust the one or more color characteristics for the subpixels associated with a region into (or substantially into) a range of values associated with imperceptible variations of color. In particular, image adjuster 116 changes color characteristics to reduce perceptible deviations of color. In some embodiments, image adjuster 116 can reduce the deviation (rather than eliminate the deviation) from the range of values that coincide with values associated with imperceptible variations of color. In some embodiments, image adjuster 116 detects subpixels 164 that are configured to transmit light that might cause a color difference of a first magnitude. The first magnitude represents a deviation between two colors that can be perceived by a human visual system. For example, the color difference can be calculated between a predicted color and a corresponding portion (e.g., a pixel) of input image 104. Image adjuster 116 operates to modify at one or more light patterns from two light sources 152 to change the color difference to a second magnitude, whereby the second magnitude can indicate that the color difference, if any, between the color generated by subpixels 164 and the color for pixel in image 104 is imperceptible to the human visual system.

To illustrate operation of boundary processor 114 and image adjuster 116, consider the following example in which image processor 110 reproduces a group of features 130*b* as part of reproduced image 180. Responsive to receiving input image 104, image processor 110 predicts backlight and associated backlight drive level signals for driving light sources 152 to generate group of features 130*a* as part of a low resolution intermediate image 160, which, in some embodiments, has an intermediate resolution between the resolutions of back modulator 150 and front modulator 170. Further, the combined light patterns along optical path 163 that form group of features 130*a* can illuminate one side of front modulator 170. At the front modulator, group of features 130*b* includes three image features: image feature ("feature 1") 132, image feature ("feature 2") 134, and image feature ("feature 3") 136.

Boundary processor 114 can detect, for example, a transition in an attribute between image feature 134 and image feature 136, and can be further configured to identify boundary 135. In some examples, boundary 135 demarcates a transition between a feature having a relatively low luminance as a dark feature (e.g., feature 136), and a feature having a relatively high luminance as a light feature (e.g., feature 134). Thus, boundary 135 is referred to as a contrast (or high contrast) boundary. Similarly, boundary processor 114 can detect a transition in an attribute between image feature 132 and image feature 136, and further configured to identify boundary 131. In some examples, boundary 131 indicates a transition between a feature having a magenta color (e.g., feature 132) and a feature having a blue color (e.g., feature 136). Thus, boundary 131 is referred to as a color boundary. Further, boundary processor 114 can detect a transition in an attribute between image feature 132 and image feature 134, and further configured to identify boundary 133 as a gradual boundary. In some examples, boundary 133 can be a transition between a feature having a red color (e.g., feature 132) and a feature having a blue color (e.g., feature 134), whereby the rate at which the transition occurs is relatively less than the rates at which transitions occurred between boundaries 131 and 135. For example, boundary 133 can represent a fade between the colors of red and blue. Thus, boundary 133 is referred to as a color fade boundary. Further, boundary processor 114 can characterize features 132, 134, and 136, as well as boundaries 131, 133, and 135, and can generate image characteristic data that specify qualities that affects the appearance of the features and boundaries, including, but not limited to, color, luminance, viewing environment illuminants and related factors, the rate of change in an attribute (e.g., color or luminance), etc. The image characteristic data specify either locally-determined qualities (e.g., at the pixel level or as group of pixels) or globally-determined qualities (e.g., including a large number of pixels or all pixels), or both.

Note that the above-described color examples are merely illustrative, and that image processor 110 can detect transitions from any color and/or contrast region to any other color and/or contrast region. Note further, that image processor 110 can detect transitions relevant to the illuminant colors and/or the colors of the color elements, examples of which are depicted in FIG. 3.

Image adjuster 116 can be configured to analyze the image characteristics and to predict the characteristics of input image 104 as they might appear in reproduced image 180. Image adjuster 116 can also modify operation of light sources 152 to facilitate a match (e.g., perceptual match) of color and/or luminance values between input image 104 and reproduced image 180. To compensate for attributes in reproduced image 180, image adjuster 116 adds or suppresses amounts of illuminants generated by back modulator 150 to adjust the color for one or more pixels (or sub-pixels). Further, image adjuster 116 can determine whether modifying an illuminant to correct a color a subpixel might affect neighboring subpixels for which the modification of the illuminant for a neighboring subpixel need not be necessary. To illustrate, consider that feature 132 includes a magenta color and feature 136 includes a cyan color. In some cases, a subpixel in area 140 produces the correct color (e.g., the color that matches a color in image 104). Subpixels in region 142 produce a color that may not match that in image 104 since they receive more blue color than is necessary in region 142 for establishing a magenta color. The excess of blue color (or, alternatively, the lack of red) can be perceived as a visible artifact at or near boundary 131. For example, light source 154*a* may operate to accurately generate a blue illuminant for pixel 141*b* (e.g., when the color blue is prioritized over the color red) for the cyan color, whereas light source 154*b* may operate to accurately generate a red illuminant for pixel 139*b* in region 142 (e.g., when the color red is prioritized over the color blue) on the other side of boundary 131. As used herein, the term "accurately," when used in the context of color reproduction, can refer to an ability to modulate or otherwise transmit a color that matches (e.g., perceptibly matches) that of the input image so that the color is perceived as intended when there may be multiple illuminants providing "competing colors" to a pixel or sub-pixel. In some cases, light source 154*b* may contribute more red than is necessary for pixel 141*b* and may contribute less red than is necessary for pixel 139*b*, with the shortfall in red color resulting in the perception of blue in region 142.

Image adjuster 116 can be configured to analyze the image characteristics, as well as predicted image characteristics (i.e., reproduced image characteristics), to determine the degree of modification of light from light sources 154*a* and 154*b* to obtain a perceptibly correct color for pixel 139*b*. In some embodiments, image adjuster 116 determines the correctness of a color by ensuring that the color difference between the color generated for pixel 139*b* and the color of pixel 139*a* in image 104 does not exceed a threshold amount of color difference. A threshold amount of color difference specifies whether a color difference may or may not be perceptible for different colors and color characteristics, in accordance with a model of a human visual system. For example, consider that modifying the drive level signals for light source 154*b* increases the amount of red illuminant 155*b* to add more red color light into pixel 139*b*, thereby reducing the amount of "blue" color in region 142 to enhance the "magenta" color. In particular, image adjuster 116 can modify red illuminant 155*b* to reduce the magnitude of the color difference between pixels 139*a* and 139*b* to an acceptable level (e.g., below the threshold amount of color difference). In some embodiments, image adjuster 116 also detects whether the modification of red illuminant 155*b* might affect the color in pixel 141*b*. In some example, increasing the red illuminant 155*b* can increase the color difference between the color generated for pixel 141*a* in image 104 and the color of pixel 141*b*. Note, however, the increased magnitude of the color difference for pixels 141*a* and 141*b* need not be perceptible when the magnitude remains less than a threshold amount of color difference for that color combination. In some embodiments, image adjuster 116 can use a neighboring pixel 137*b* as a reference to which a color difference determination can be made, as pixel 137*b* is removed from the boundary and can generate the color for pixel 137*b* to match the color of pixel.

Image adjuster 116 can be configured to modify colors of pixel 139*b* by adjusting one or more color characteristics into a range of values associated with pixel 139*a*. As used herein, the term "color characteristic" can refer to, at least in some embodiments, as a quality that can be modified to change a color with or without affecting the perception that the color has changed. Examples of color characteristics include hue, brightness, saturation, and chromacity, or any other descriptor of color for any color model or color appearance model. Other examples of color characteristics include a color difference or any other quality that be used describe color and to quantify deviations between colors. A color difference can be described in terms of delta E. Delta E is a measure of the difference between two colors, one which is a reference color and the other of which is a sample color that image adjuster 116 modifies. Examples of implementations of delta E suitable for use by image adjuster 116 are the delta E definitions set forth by the International Commission on Illumination ("CIE") headquartered in Vienna, Austria. Or, image adjuster 116 can be configured to implement any other technique for determining a perceptible difference between one color and another. As used herein, the term "range of values" can refer to, at least in some embodiments, as a range of quantities that describe either color characteristics individually or collectively, with the range of quantities being useable to determine whether a color of a sample pixel (e.g., pixel 139*b*) matches (or perceptually matches) a color of a test pixel (e.g., pixel 139*a*). For example, the hue, brightness, and saturation of test pixel can vary within a range of hue values, a range of brightness values, and a range of saturation values, respectively, and still can be perceived as having the same color. Note that in some embodiments, a range of values can be influenced by the color and brightness of a particular color. For example, a difference in luminance (e.g., brightness) from 10 cd/m^2 to 11 cd/m^2 is more perceptible than a difference between 100 cd/m^2 and 101 cd/m^2. Image adjuster 116 can detect the differences when using, for example, delta E techniques to measure the difference between two colors. Image adjuster 116 can modify one or more of the color characteristics to approximate the values for one or more of the ranges. In some embodiments, ranges of values of color characteristics can be described in terms of pixel values (e.g., from 0 to 255) for red, green and blue.

As used herein, the term "color" can refer, at least in some embodiments, to a perceived color associated with a spectral distribution of a color stimulus, as well as the viewing conditions (e.g., the size, shape, structure, and surround of the area in which the color stimulus originates). Color can also depend on an observer's visual system and its ability to adapt to different illuminants, among other things. The term color, according to some embodiments, can also refer to an amount (e.g., a measured amount) of spectrally weighted photons entering the human visual system as a result of being emanated from a surface of, for example, a display device. In some embodiments, a color can be expressed in terms of a spectral power density, such that differences in color can be expressed in differences in spectral power densities. As used herein, the term "competing colors" can refer to, at least in some embodiments, to the colors of illuminants that are competing for transmission via a color element configured to transmit those colors. Examples of competing colors include red illuminant 161*b* and blue illuminant 161*a*. As used herein, the term "sub-pixel" can refer, at least in some embodiments, to a combined structure and/or functionality composed of (or associated with) one of color elements 162 and 164 and a modulating element. As used herein, the term "pixel" can refer, at least in some embodiments, to a combined structure and/or functionality composed of (or associated with) a pixel mosaic 160 and a collection of modulating elements (e.g., four modulating elements). In some embodiments, a modulating element is disposed in an array of liquid crystal display ("LCDs") devices, such as active matrix LCD devices. As used herein, the term "light source" can refer to, at least in some embodiments, any light source that can be configured to generate an illuminant with color, and a light source can be controlled individually or in groups to modulate the generation of the illuminant. An example of a light source is a light emitting diode ("LED").

Figure 2A:
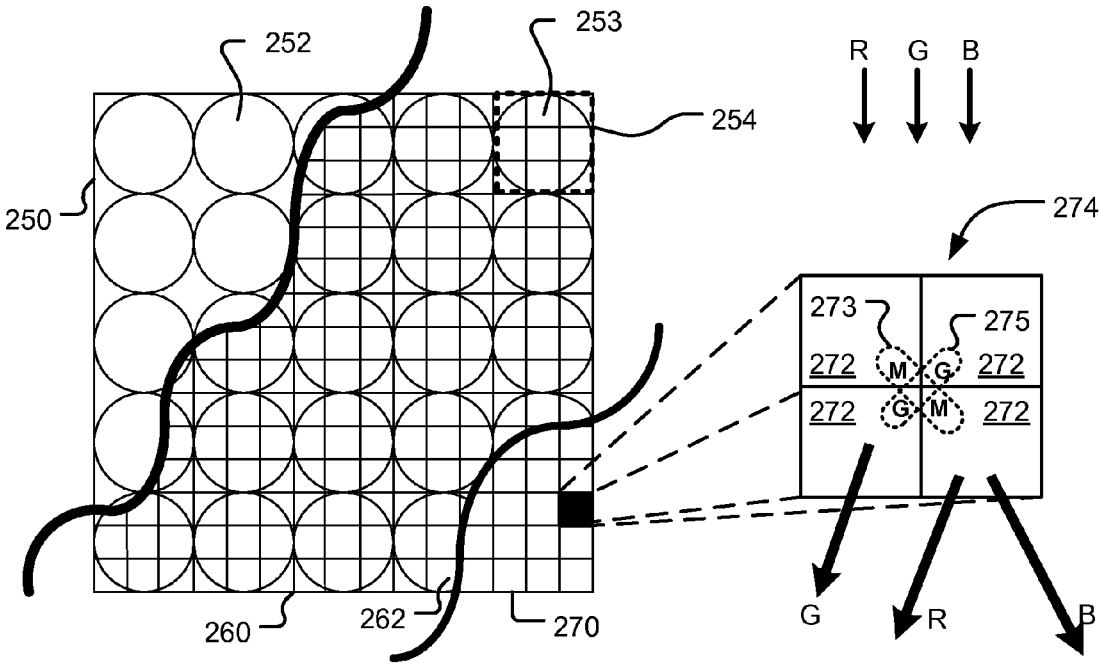
FIGS. 2A and 2B depict examples of rear and front modulators, according to at least some embodiments of the invention
Figure 2B:
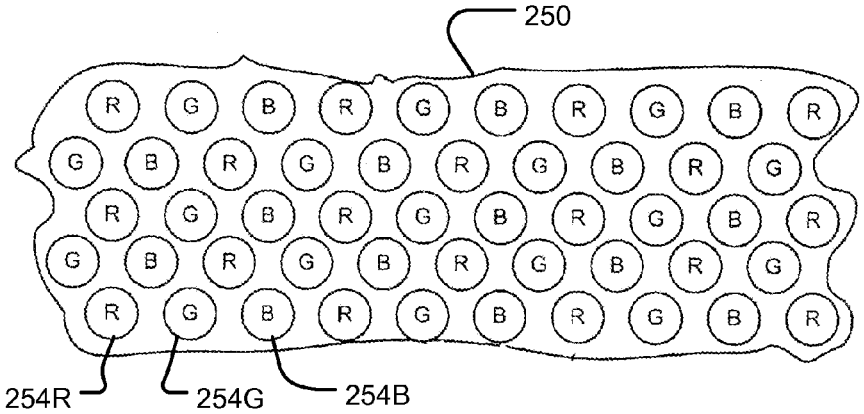

FIGS. 2A and 2B depict exemplary rear and front modulators, according to at least some embodiments of the invention. Here in FIG. 2A, back modulator 250 includes a plurality of light sources 252, and front modulator 260 includes a plurality of pixels 262. In some examples, a single light source 253 may be disposed behind several pixels 254 (in dotted box) of front modulator 250. In other examples, there may be a plurality of light sources 252 that illuminate a plurality of pixels 262 with red, green and blue colors. In some embodiments, a filter 270 is disposed along an optical path of front modulator 260 and includes a plurality of color elements 272. In some examples, the subpixels in pixels 262 and color elements 272 are of similar resolution. For example, a pixel 274 can include as many as two types of color elements for any number of sub-pixels, such as color elements 273 and color elements 275, either or both of which may provide for color synthesis control in some examples. In other examples, each of the 4 sub-pixels is individually controlled to provide color synthesis control of color element 272. While magenta (M) color filters 273 and green (G) color filters 275 can be used for in association with sub-pixels 272 in some embodiments, other pairs of colors for color elements 272 are possible. For example, a two sub-pixel element can be selected as a color pair from a group comprising magenta-green, cyan-magenta, cyan-yellow, blue-yellow, magenta-yellow, and red-cyan.

FIG. 2B depicts an example of a back modulator having an arrangement of light sources as modulating elements in an array 250. In this example, light sources 254 are LEDs, and array 250 includes either a symmetrical or asymmetrical arrangement of light sources 254 so as to enable a relatively uniform illumination to be generated by the light emitted from any one of the colors for which there are light sources. For example, modulating elements 254 may include red color light source 254R, green color light source 254G, and blue color light source 254B. In some examples, the point spread functions of adjacent light source 254 of each (R, G, or B) color overlap with one another, and an image adjuster operates to modify the overlap to add or suppress amounts of illuminants.

FIG. 3 depicts examples of pixel mosaics and associated competing color pairs, according to some embodiments of the invention. In the examples shown in diagram 300, column 302 specifies particular combinations of two-types of color elements for a pixel, with column 304 indicating possible color competition situations. Further, column 306 specifies the colors at boundaries that might include artifacts. For example, with a green/magenta pixel mosaic, a blue color of priority might compete against non-blue colors, including a red color. A boundary processor operates to detect the boundaries and transitions between the following color features: magenta-cyan boundaries, blue-yellow boundaries, and green-red boundaries.

Figure 4:
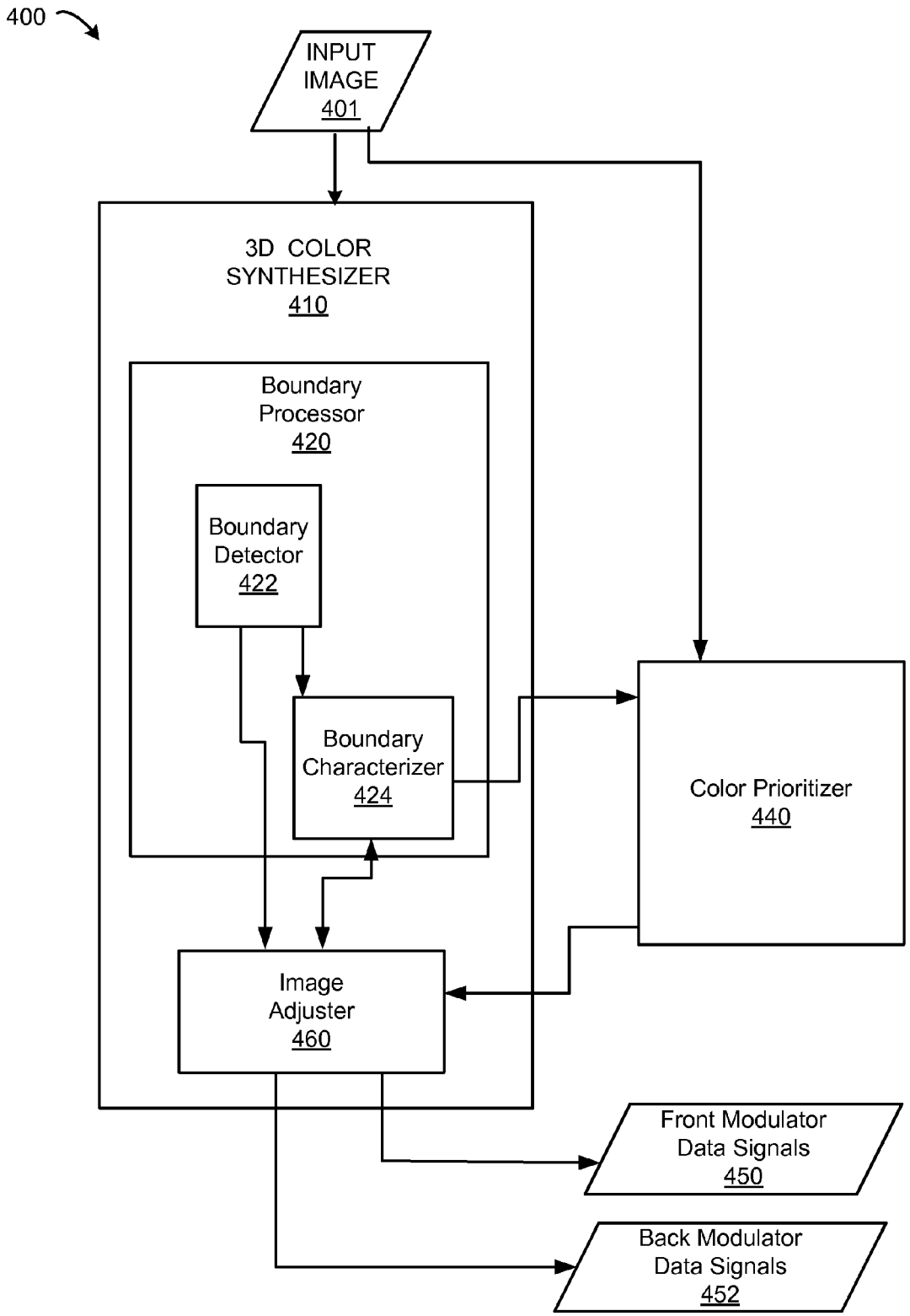
FIG. 4 depicts an example of a three dimensional ("3D") color synthesizer, according to some embodiments of the invention.

FIG. 4 depicts an example of a three dimensional ("3D") color synthesizer, according to some embodiments of the invention. In diagram 400, a three dimensional color synthesizer 410 includes a boundary processor 420 and an image adjuster 460, and operates to interact with a color prioritizer 440. Three dimensional color synthesizer 410 receives input image 401 and applies three dimensional color synthesis techniques and/or structures to generate drive signals for forming an image with accurate attributes (e.g., perceptually accurate colors and/or luminance). Three dimensional color synthesizer 410 is shown to include a boundary processor 420, which, in turn, can include a boundary detector 422 and a boundary characterizer 424.

Boundary detector 422 can detect boundaries to which image adjustments can be applied. For example, boundary detector 422 can detect a boundary between at least two groups of subpixels (e.g., color elements) configured to generate reproduced image portions with different values of an attribute. In some embodiments, boundary detector 422 determines a contrast ratio between the different colors, the contrast ratio specifying whether there is a boundary between, for example, darkly-lit features and brightly-lit features.

Boundary characterizer 424 can be configured to characterize image 401 to generate image characterization data for a portion of image 401, such as a pixel in image 401, the image characterization data including a characterized attribute (e.g., a color or luminance value for image 401). The image characterization data can be determined locally or globally. Examples of image characterization data include: (1.) data representing color, luminance, environment attributes, (2.) data representing rates in change between attributes (e.g., indicating a color fade at a boundary), (3.) data representing indications whether a transition in an attribute qualifies as boundary or edge between image features, (4.) data representing brightness, hue, saturation, chromacity, as well as other qualities of an image, (5.) data representing a spatial frequency (or frequencies) between opponent colors at a boundary. In some embodiments, boundary characterizer 424 characterizes a predicted image to generate reproduced image characterization data for a reproduced portion of a reproduced image. Examples of reproduced image characterization data include those as indicated above for image characterization data, but are predicted data.

Color prioritizer 440 can be configured to determine and to identify which color is deemed to be either the predominant color or the "most important color" for a subpixel, pixel, or group of pixels, and can be further configured to generate color importance map data. Image adjuster 460 can use color importance data to determine, for example, which color in a group of colored illuminants can be modulated by a subpixel (or pixel) of a front modulator. For example, if both red and blue illuminants are competing colors that can transmit through a magenta color filter, generally one or the other can be determined to be the prioritized color for which the subpixel modulates. In some embodiments, color prioritizer 440 modifies the prioritization of a color responsive to the characterization data.

In various embodiments, color prioritizer 440 prioritizes a color over other colors (including ranking of colors from most to least important) based on one or more of the following: (1.) The color with the highest average brightness per subpixel (in a group of subpixels) can be prioritized as the highest. The average brightness can be determined for each color by, for example, summing the values of brightnesses for each subpixel in a pixel (or group of pixels). (2.) The color having the highest average pixel values in a pixel or group of pixels is prioritized first. The average pixel values can be determined for each color by, for example, summing pixel values for each subpixel in a pixel (or for each pixel in a group of pixels). In some cases, the pixel values can be related to brightness by scaling factors to adjust the colors in accordance with the sensitivity of the human visual system. (3.) The color having a maximum brightness for any subpixel (in a pixel) or for any pixel (in a group of pixels) can be prioritized as the highest. (4.) The color having a maximum pixel value for any subpixel (in a pixel) or for any pixel (in a group of pixels) can be prioritized as the highest. (5.) The color having the maximum variation in brightness or pixel value (or some combination of brightness and pixel value) for a subpixel (in a pixel) or a pixel (in a group of pixels) can be prioritized highest. The variation can be a range that can be determined by subtracting the minimum brightness for a color in the pixel or group of pixels from the maximum brightness for the color in the pixel or group of pixels, or from another measure of variation. (6.) The color that exhibits the greatest degree of spatial clustering for a subpixel (in a pixel) or a pixel (in a group of pixels) can be prioritized as the highest. For example, if a relatively large number of contiguous subpixels (in one or more pixels) or contiguous pixels (in a group of pixels) have similar pixel values for a color, then that color has a large degree of spatial clustering and thereby can be prioritized as the highest. Color prioritizer 440 then generates color importance data representing the ranking of color that describes the relative importance to one or more of the colors produced by a subpixel, pixel or group of pixels.

In one embodiment, color prioritizer 440 determines a color priority based on an attribute of an image that is to be preserved, such as a ratio between colors, a luminance value, or a specific color. Further, color prioritizer 440 determines which of the attributes should be preserved to obtain a reduced perceived color difference (e.g., delta E) between a reproduced image and the original image. In some examples, color prioritizer 440 chooses to "prioritize" a certain attribute (e.g., color, ratio, or luminance) over other attributes to minimize the color difference.

Image adjuster 460 can to adjust an image based on the color importance data. In some embodiments, image adjuster 460 can be configured to predict backlight for a reproduced image, and then can predict an attribute associated with a subpixel for a reproduced image. In particular, image adjuster 460 characterizes the predicted image to generate reproduced image characterization data that can include a characterized attribute. Further, image adjuster 460 modifies the characterized attribute to adjust a color difference value into the range of color difference values. Image adjuster 460 also determines the drive level signals for both driving the modulating elements in a front modulator and driving the light sources in a back modulator to produce perceptibly correct color (or nearly so) at a subpixel. Thus, image adjuster 460 generates front modulator data signals 450 and back modulator data signals 452.

Figure 5A:
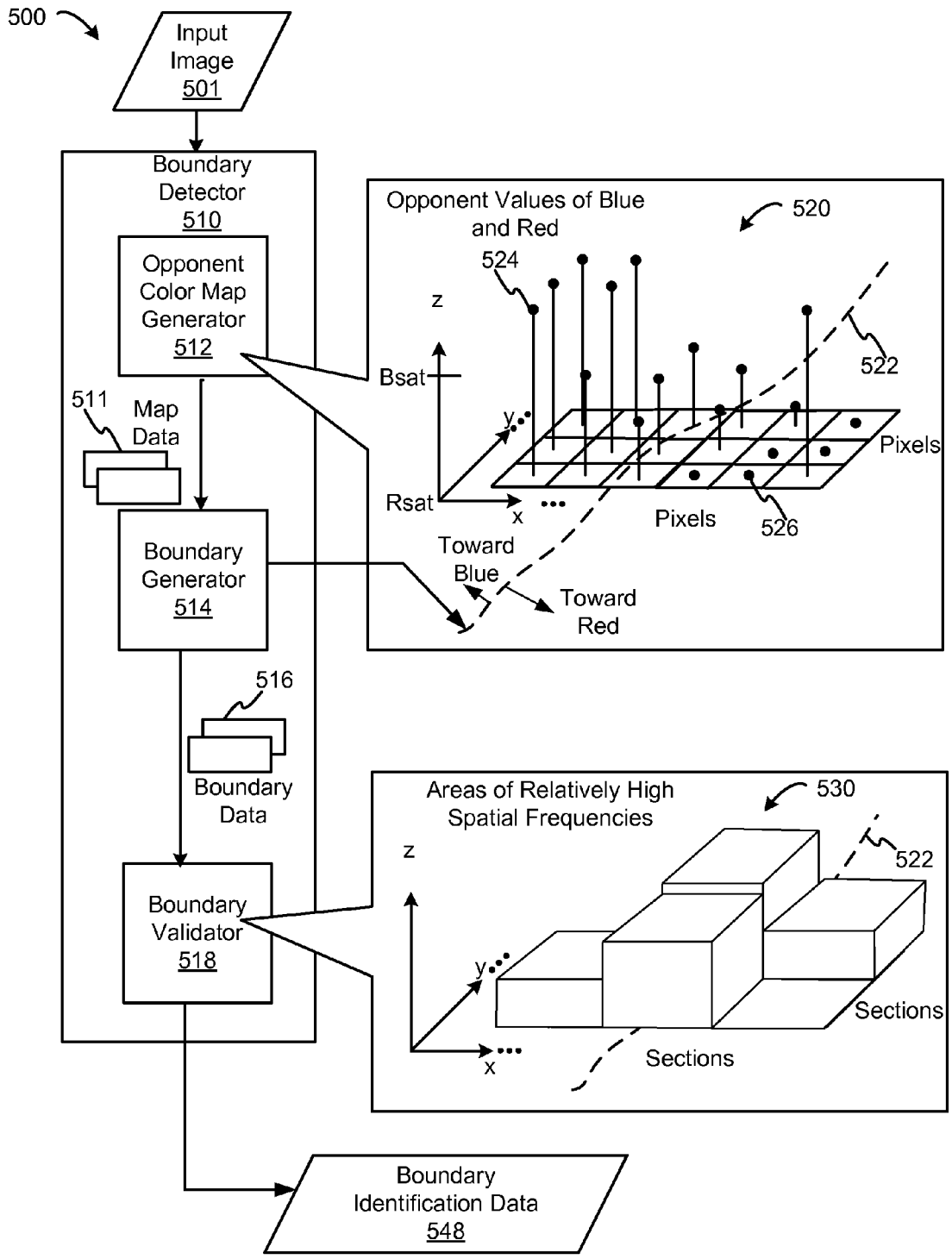
FIG. 5A depicts an example of a boundary detector, according to some embodiments of the invention.

FIG. 5A depicts an example of a boundary detector, according to some embodiments of the invention. As shown in diagram 500, a boundary detector 510 includes an opponent color map generator 512, a boundary generator 514 and a boundary validator 518. Boundary detector 510 detects boundaries associated with image features in an input image 510, and generates boundary identification data signals 548 that identify the boundaries and one or more subpixels or pixels associated thereto. Opponent color map generator 512 operates to specify amounts of competing colors in, for example a 2-subpixel mosaic, where the term "opponent" can be used to describe the opponency of competing colors such that each competing color can be described as an opponent of the other. In some embodiments, opponent color map generator 512 generates data describing the relative amounts of the opponent colors, the data being generated for a subpixel, pixel or group of pixels. Note that, in some embodiments, the term "map" can refer to a data structure that relates subpixels, pixels, and groups of pixels to image-related parameters (e.g., attribute information, including color and luminance). Note, too, that a map as a data structure need not include information about all subpixels, but is limited to map data at or adjacent to a boundary, according to some embodiments.

As an example, consider that opponent color map generator 512 generates an opponent color map specifying normalized amounts of opponent color, such as normalized amounts of red color and blue color. In this example, the opponent color map is a "Blueness vs. Redness" map for situations in which blue and red are competing colors with respect to a color element in a 2-pixel mosaic. In this case, the following equation may be used for a subpixel or pixel:

$$\text{Blueness vs. Redness Map}=0.5-0.5*\text{Red}+0.5*\text{Blue}$$

This creates an opponent color map, as shown in representation 520, in which a value of "1" specifies a full blue color 524 (e.g., fully saturated blue, or B sat) with no red (regardless of the green value), and a value of "0" specifies a full red color 522 (e.g., fully saturated red, or Rsat) with no blue (regardless of the green value). Note that since the human visual system may respond differently depending upon how much green is present, a green component could be added into this mapping equation, according to some embodiments.

Note that in some embodiments, the back modulator includes blue and yellow light sources. In this case, the opponent color map is a "Blueness vs. Yellowness" map and is used to control subpixel and pixel modulation should blue light and yellow light be considered competing colors in a color element in a 2-pixel mosaic. In this case, the following equation may be used for a subpixel or pixel, for example:

$$\text{Blueness/Yellowness Map}=0.5+0.5*\text{average(Red, Green)}-0.5*\text{Blue}$$

This can create an opponent color map that is a normalized image map that is, in the extremes, equal to "1" for a saturated yellow, and equal to "0" for saturated blue.

Boundary generator 514 can detect a boundary 522 using opponent color map data 511. In some embodiments, boundary generator 514 detects a change of an attribute (e.g., color) as a change in opponent values. Thus, boundary generator 514 detects a change in both a first color (e.g., blue color), which can be associated with a light pattern of a first illuminant, and a second color (e.g., red color), which can be associated with a second light pattern. In some embodiments, boundary generator 514 detects a reciprocal change in the first colored illuminant and the second colored illuminant between a first group of color elements (e.g., associated with values 526) and a second group of color elements (e.g., associated with values 524). In some embodiments, boundary generator 514 determines a boundary in a variety of ways. For example, a boundary can be determined by: (1.) the change in magnitude of a opponent color map value (e.g., from 0.8 to 0.2) over two or more subpixels or pixels, (2.) the rate of change of a opponent color map value of a unit of space, as well as other ways to determine a boundary. In some embodiments, boundary generator 514 can be configured to detect a boundary as an edge. Thus, a Sobel edge detection technique, as well as any other known edge tracking or identifying techniques, can be used for color and/or contrast edge detection. Boundary generator 514 can transmit boundary data 516 specifying a boundary to boundary validator 518.

Boundary validator 518 can be configured to validate whether boundary 522 (or edge) is a valid boundary, or, for example, an area composed of dithered values of two colors. In some embodiments, boundary validator 518 validates a boundary by first determining an amount of change in a first colored illuminant and a second colored illuminant over a first area, and then by matching the result to a threshold specifying that boundary 522 is an edge (e.g., a relatively "sharp" edge). In at least one embodiment, boundary validator 518 determines the relative frequency of the changes in opponent color map values (and/or intensity) for a section of pixels. If the relative frequency of color changes is associated with a relatively high spatial frequency per unit area, then boundary 522 is identified as an edge or boundary. As an example, representation 530 depicts the average quantities that specify the number of changes in color for a given area (or section). In specific embodiments, the spatial frequencies and the boundaries between regions of opposing colors (e.g., from opponent color map) are used as an input to a color/luminance prioritization scheme.

Figure 5B:
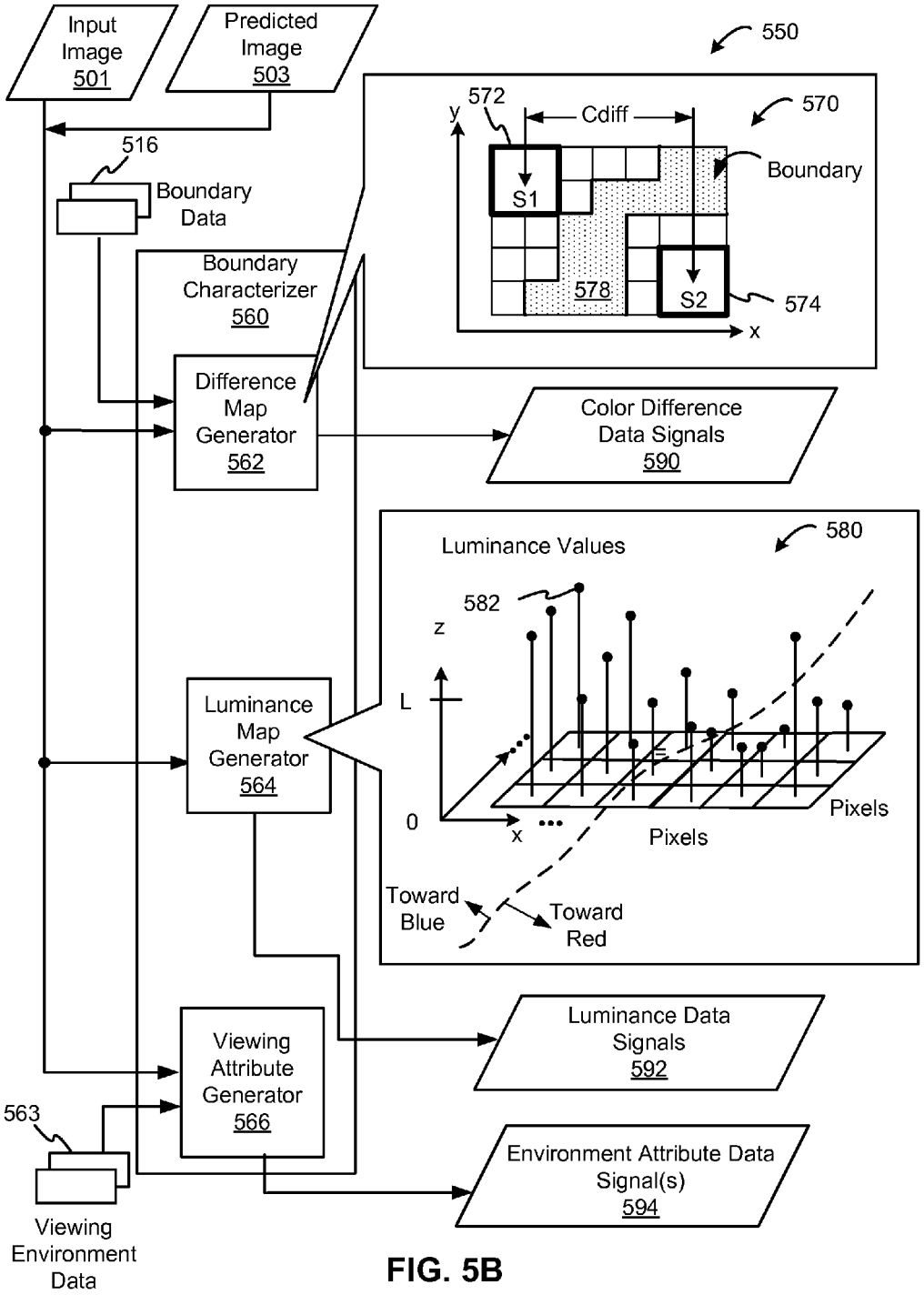
FIG. 5B depicts an example of a boundary characterizer, according to some embodiments of the invention.

FIG. 5B depicts an example of a boundary characterizer, according to some embodiments of the invention. As shown in diagram 550, a boundary characterizer 560 includes a difference map generator 562, a luminance map generator 564, and a viewing attribute generator 566. Boundary characterizer 560 operates to characterize a boundary as well as adjacent features, and to generate respective color difference data signals 590, luminance data signals 592, and environment attribute data signals 594. Note that boundary characterizer 560 can characterize both input image 501 and a predicted image 503 (e.g., from an image adjuster) that is used to predict backlight and other aspects of a reproduced image. Difference map generator 562 receives boundary data 516 from boundary generator 514 (FIG. 5A) to determine differences with respect to a boundary, and generates a color difference map at or adjacent to the boundaries. In some embodiments, difference map generator 562 generates map data that represents the difference in color between the two sides of a boundary. To illustrate operation of difference map generator 562, consider representation 570 for which difference map generator 562 can identify a sample ("S1") of a group of subpixels/pixels on one side of boundary 578, and can identify another sample ("S2") of a group of subpixels/pixels on the other side. Difference map generator 562 can generate a value ("Cdiff") that represents a color difference between the two samples. In this case, an image adjuster operates to maintain the color difference to keep different colors perceptibly separate. In some embodiments, difference map generator 562 determines the differences in luminance values between both sides, as expressed in a contrast ratio.

Luminance map generator 564 can be configured to specify luminance values for a subpixel, pixel, or a group of pixels of image 501 in relation to a boundary. As a model of a human visual system has different levels of sensitivity for different colors, this sensitivity relationship may depend upon a luminance value of a color. Thus, a luminance map can indicate that the luminance values at or adjacent to a boundary that can be evaluated for matching predicted color with color in input image 501. Representation 580 illustrates an example of a luminance map of luminance values 582.

Viewing attribute generator 566 can be configured to specify viewing attribute values, which can be global in nature, for a group of pixels in relation to a viewing environment. Viewing attribute generator 566 receives viewing environment data 563 from a source of viewing environment data, such as a sensor and/or computing device that determines the viewing characteristics for a viewing environment. Or, viewing attribute generator 566 receives metadata (e.g., embedded in a medium, such as a video file) that includes information about the source environment (e.g., the environment in which image 501 is captured) or about the viewing environment in which a front modulator resides. In some embodiments, viewing environment data 563 includes: global luminance information, such as a value of a luminance of an adapting field; the color or color temperature of an illuminant at the viewing environment; and any other color appearance-related parameters. In some examples, viewing attribute generator 566 generates a state of adaption that describes the viewing environment as part of environment attribute data signals 594. An image adjuster uses data 594 to predict an image under certain viewing conditions, which, in turn, can improve color reproduction.

Figure 6A:
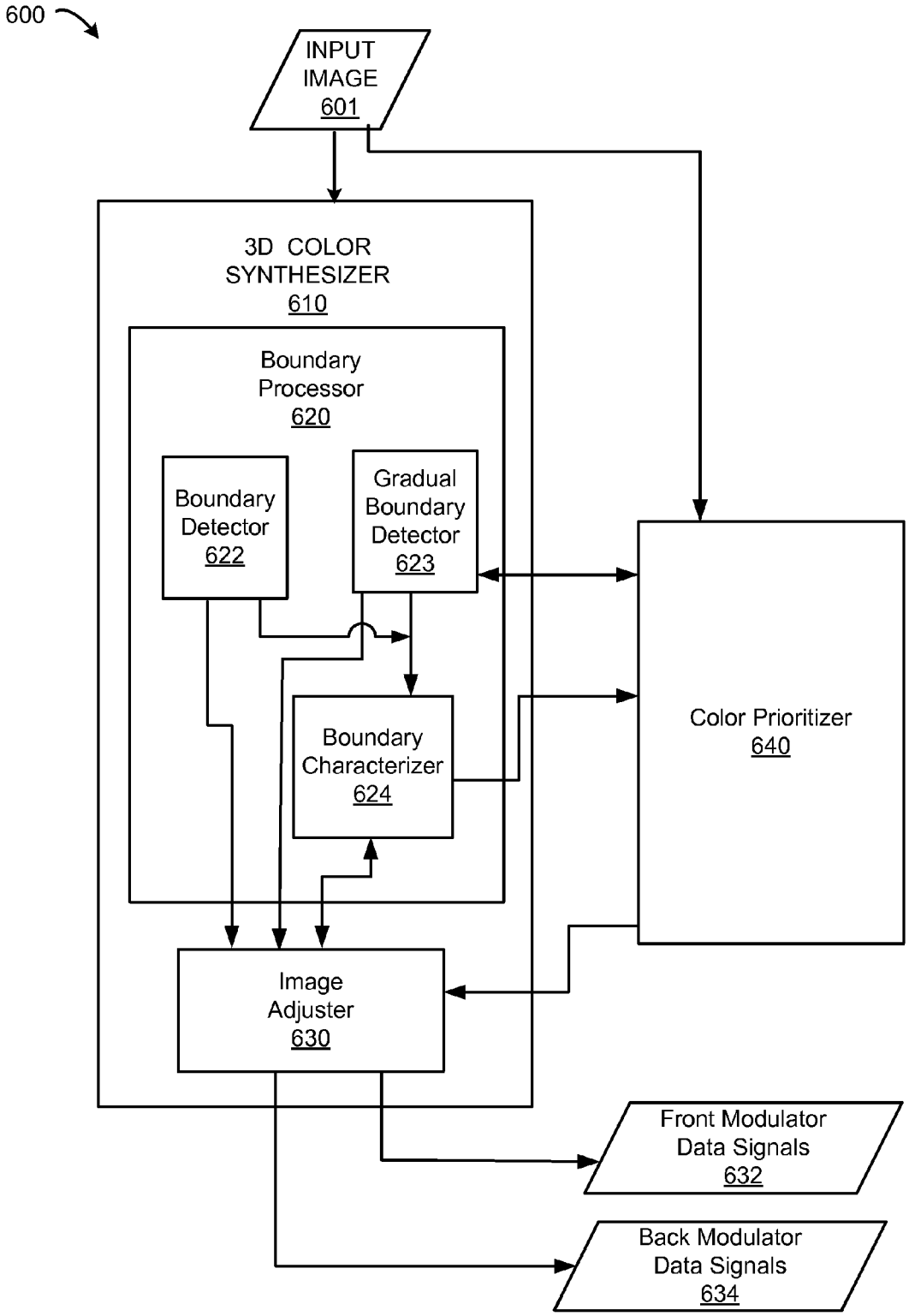
FIG. 6A depicts an example of a three dimensional ("3D") color synthesizer, according to some embodiments of the invention.

FIG. 6A depicts an example of a three dimensional ("3D") color synthesizer, according to some embodiments of the invention. In diagram 600, a three dimensional color synthesizer 610 includes a boundary processor 620 and an image adjuster 630, and operates to interact with a color prioritizer 640. Three dimensional color synthesizer 610 receives input image 601 and applies three dimensional color synthesis techniques and/or structures to generate drive front modulator data signals 632 and back modulator data signals 634 to generate an image with accurate attributes (e.g., perceptually accurate colors and/or luminance). Three dimensional color synthesizer 610 is shown to include a boundary processor 620, which, in turn, includes a boundary detector 622, a gradual boundary detector 623 and a boundary characterizer 624. Elements in FIG. 6A can have similar or equivalent structures and/or functionalities as similarly-identified elements in FIG. 4.

Gradual boundary detector 623 can detect gradual boundaries to which image adjustments can be applied, according to some embodiments. For example, gradual boundary detector 622 detects an amount of change (e.g., an incremental change) from a first colored illuminant to a second colored illuminant over an area to validate that the boundary from one color to another color is a gradual boundary. In some embodiments, gradual boundary detector 623 detects gradual changes from one opponent color (e.g., blue) to another opponent color (e.g., red), both of which are competing colors. In some embodiments, color prioritizer 640 operates to determine a priority color locally through a "most important color" (MIC) determination. The term "locally" can refer to subpixel-by-subpixel computations, pixel-by-pixel computations, or computations on a small grouping of pixels. In some cases, an artifact may arise in image areas where there is a gradual fade from one color to another. For example, consider that the determination of a priority for a color uses a threshold value for the pixel values (e.g., RGB values) of input image 601. Thus, an artifact might arise when, for example, opponent colors alternate in highest priority color when amounts of opponent color values are equivalent (e.g., ≈50/50). At such boundaries, a relatively sharp image color change may be visible. Gradual boundary detector 622 detects such a boundary and forms a gradual transition of the most-important-color determination in areas where there is a gradual fade between, for example, opponent colors.

Figure 6B:
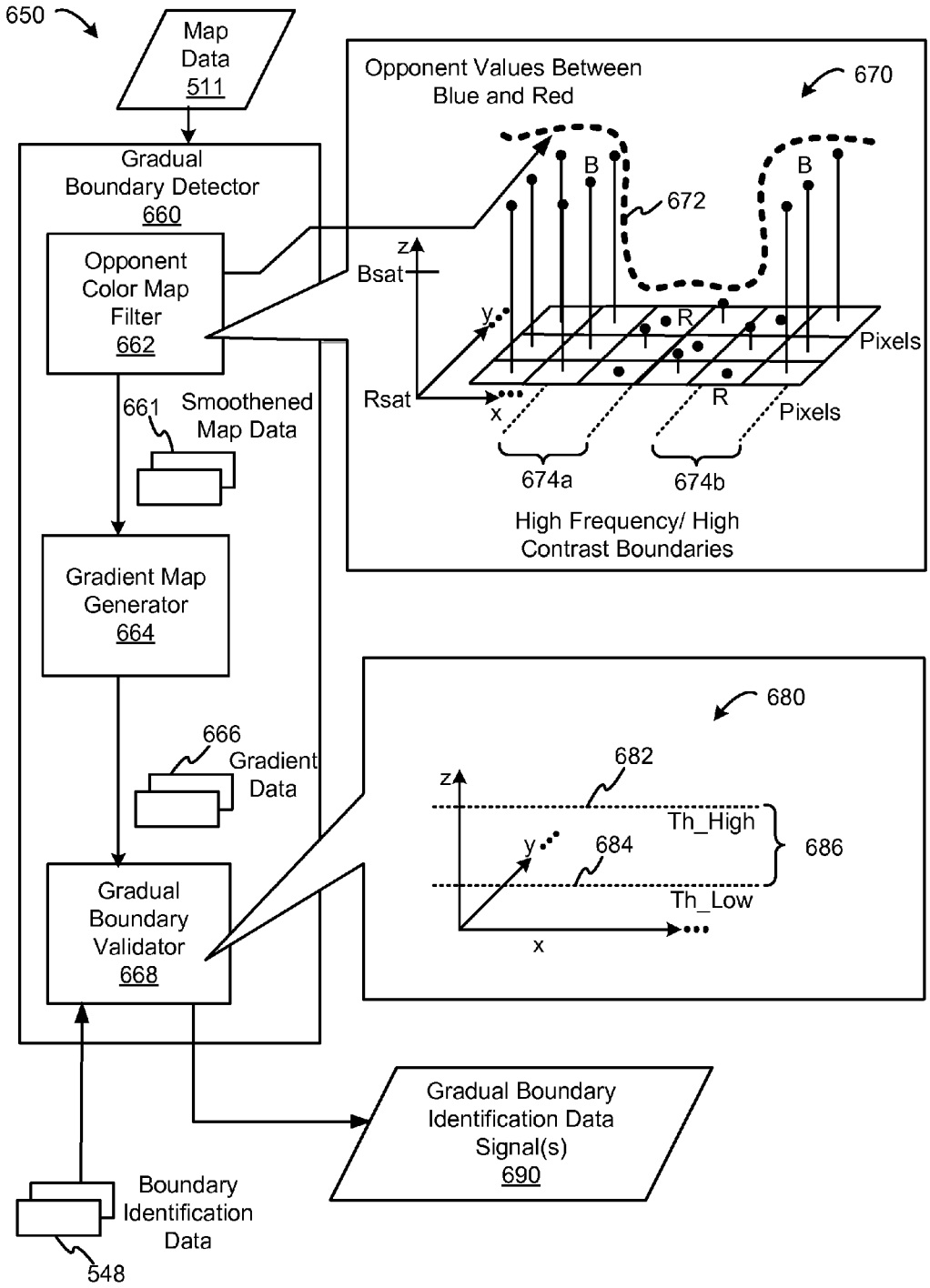
FIG. 6B depicts an example of a gradual boundary detector, according to some embodiments of the invention.

FIG. 6B depicts an example of a gradual boundary detector, according to some embodiments of the invention. As shown in diagram 650, a gradual boundary detector 660 includes an opponent color map filter 662, a gradient map generator 664, and a gradual boundary validator 668. Gradual boundary detector 660 characterizes a color fade boundary as well as adjacent features, and generates gradual boundary identification data signals 690, which identify the boundaries with respect to subpixels and include image-related information. Note that boundary characterizer 660 can receive as an input opponent color map data 511 from, for example, opponent map generator 512 (FIG. 5A).

Opponent color map filter 662 can be configured to receive opponent color map data 511 and to reduce or eliminate high frequency color opponent image information that otherwise might be treated as relatively high frequency-related boundaries (i.e., as a relatively sharp edge). In some embodiments, opponent color map filter 662 applies a smoothing filter, such as a Gaussian filter, to an opponent color map to smoothen or blur edges, including edges 672, that otherwise can be determined to be high frequency contrast boundaries 674*a* and 674*b* in representation 670. Opponent color map filter 662 transmits the smoothened data 661 to gradient map generator 664.

Gradient map generator 664 can generate a gradient map that describes the rate of change of an attribute, such as color or luminance, among adjacent subpixels (or pixels) for the smoothened opponent color map data. In particular, the gradient map is a difference map generated by determining a gradient derivative at subpixels or pixels at or near a boundary (e.g., a candidate gradual boundary yet to be validated). Thus, subpixels can be associated with a value that describes a rate of change associated with one or more subpixels, and, optionally, a direction of the rate of change (e.g., increasing or decreasing). Gradient data 666 describes the magnitudes of rates of change of one or more colors.

Gradual boundary validator 668 can be configured to determine whether a rate of change in color qualifies as gradual boundary rather than being either a relatively sharp edge or boundary or a relatively constant value (e.g., not a relatively slow transition or not a transition to an opposing color). In some embodiments, a threshold filter (e.g., a "top hat" filter) is applied to gradient data 666 having a non-zero color opponent derivative. Representation 680 shows an example of a range 686 of rates of change that indicate a boundary is a gradual boundary. Rates of change above a high threshold ("Th_High") 682 can be discarded as being relatively too sharp, whereas rates of change below a low threshold ("Th_Low") 684 can be discarded as being relatively too constant (e.g., low and non-zero opponent colors). In some embodiments, gradual boundary validator 668 accepts boundary identification data 548 from FIG. 5A to exclude transitions that are determined to be boundaries (e.g., relatively sharp edges) by a boundary detector 510.

Figure 7A:
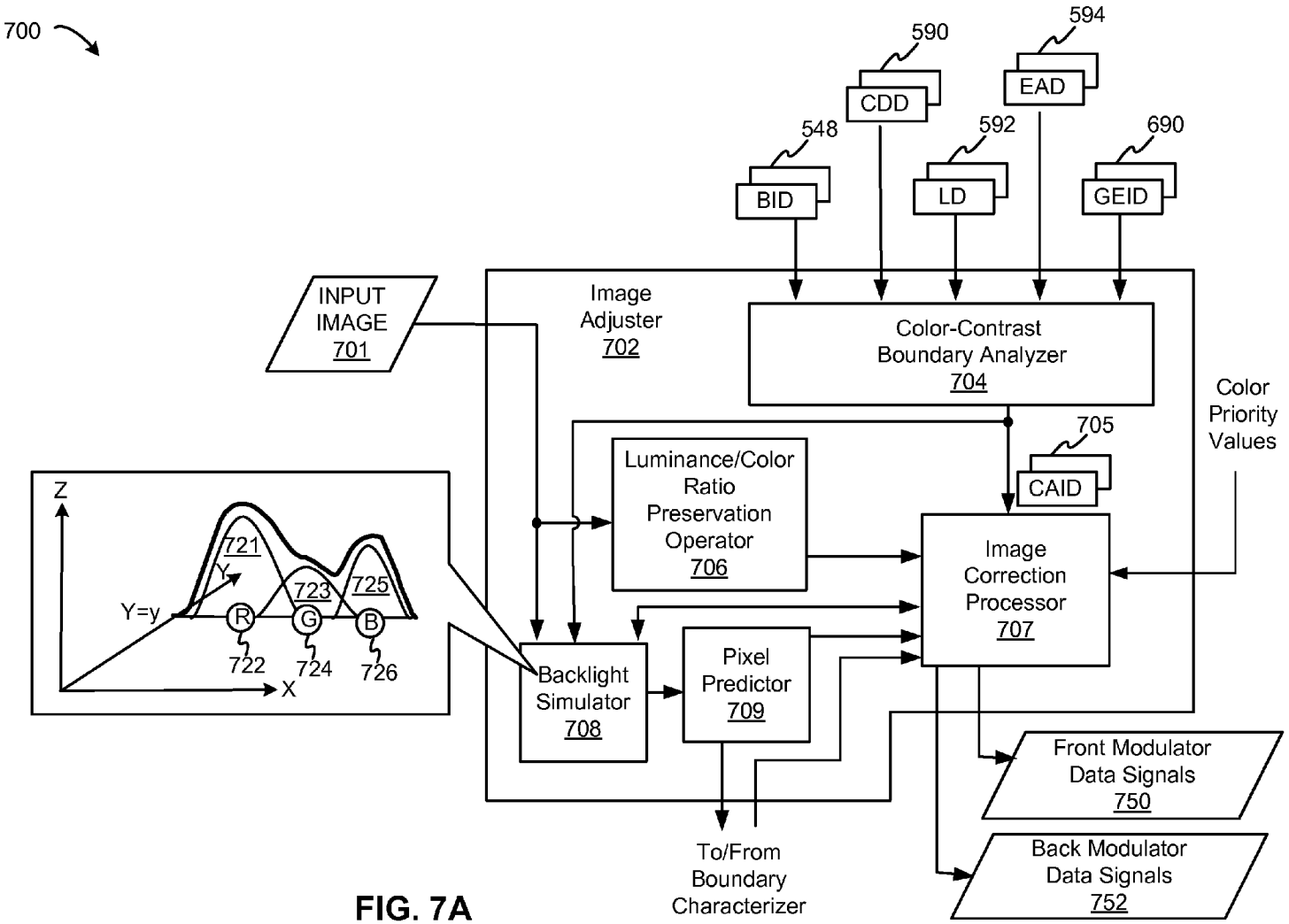
FIG. 7A depicts an example of an image adjuster, according to some embodiments of the invention.

FIG. 7A depicts an example of an image adjuster, according to some embodiments of the invention. As shown in diagram 700, an image adjuster 702 includes a color-contrast boundary analyzer 704, a luminance/color ratio preservation operator 706, an image correction processor 707, a backlight simulator 708 configured to generate predicted light patterns for a predicted backlight, and a pixel predictor 709 configured to generate a predicted color based on the predicted light patterns. Color-contrast boundary analyzer 704 can be configured to receive data from various sources described herein.

For example, color-contrast boundary analyzer 704 can be configured to receive boundary identification data ("BID") 548 from boundary detector 510 (FIG. 5A), color difference data signals ("CDD") 590 from boundary characterizer 560 (FIG. 5B), luminance data signals ("LD") 592, environmental attribute data signals ("EAD") 594, and gradual boundary identification data signals ("GEID") 690 from gradual boundary detector 660 (FIG. 6B). In some embodiments, color-contrast boundary analyzer 704 generates a value or values based on a weighted combination of the above-described data. These values are used to determine the relative importance of the color accuracy for opponent colors, in view of the sensitivities of the human visual system. Color accuracy importance data ("CAID") 705 are transmitted to image correction processor 707, which, in turn, determines how a front modulator and a back modulator should employ, for example, opponent color values and/or luminance values at boundaries. In some embodiments, the weightings can be predetermined or can be determined based on the content of input image 701, such as in cases where there is relatively large number of high spatial frequency determinations made, and a relatively large number of pixels include opponent colors. In this case, boundaries may be analyzed more closely to capture or reduce opportunities for artifacts due to opponent color boundaries.

Luminance/color ratio preservation operator 706 can analyze input image 701 and generate data to preserve original image luminance values of image 701 and/or preserve original color ratio values of image 701. Backlight simulator 708 predicts backlight for the back modulator (not shown) to form data representing a predicted backlight, the predicted backlight including predicted values for a first colored illuminant and a second colored illuminant. In some instances, the first and second colored illuminants include opposing colors. In at least some embodiments, backlight simulator 708 determines predicted drive values configured to modify one or more colored light sources to adjust a color difference value, as determined by image correction processor 707, into a range of color difference values that provide for imperceptible color differences (or substantially imperceptible color differences). Pixel predictor 709 operates to predict a color value representing the color for a subpixel of the reproduced image at a front modulator (not shown), the color value being based on the predicted values of the backlight.

In some embodiments, backlight simulator 708 generates data representing one or more models of backlight at resolutions that are lower than the number of pixels (or sub-pixels) associated with a front modulator. In at least some embodiments, backlight simulator 708 generates data representing a model of backlight for a first spectral power distribution, such as generated by a blue light source 726, a second spectral power distribution, such as generated by a green light source 724, and a three spectral power distribution, such as generated by a red light source 722. For example, backlight simulator 708 can generate data representing a model of backlight for blue-colored light patterns 725, a model of backlight for green-colored light patterns 723, and a model of backlight for red-colored light patterns 721. In some embodiments, backlight simulator 708 generates a model of backlight by determining a target backlight for a spectral power distribution using input image 701, the target backlight being a down-sampled or lower resolution version of input image 701. Backlight simulator 708 derives the intensities (or luminance values), and then predicts the drive values to be applied to the light sources, such as in an array of light sources for generating a blue color of light. For the predicted drive values, a point spread function or a Gaussian-like filter can be applied to the luminance values of the target backlight to determine an aggregated value, which can be referred to as "simulated backlight." As used herein, the term "light pattern" can refer, at least in some embodiments, to a pattern of light having various values of luminance or intensity for a spectral power distribution that includes color (e.g., red, green, blue, cyan, yellow, etc). Thus, a light pattern also can be a low resolution image of input image 701 for a specific color, and, as such, a light pattern can be associated with either a target backlight or a simulated backlight. In some embodiments, the term "predicted light pattern" can refer to a pattern of light generated in accordance with data representing a model of backlight (e.g., simulated backlight). In at least one embodiment, the term "light pattern" can be used interchangeably with the term "backlight."

Image correction processor 707 can determine degree to which to modify a certain attribute of a light pattern from one or more of light sources 722, 724, and 726 to preserve at least one of the color ratios provided from luminance/color ratio preservation operator 706. In other instances, either color ratio values or luminance values, or both, of a predicted image (as generated by backlight simulator 708 and pixel predictor 709) are modified by image correction processor 707 to match (or substantially match) those of input image 701. In some embodiments, image correction processor 707 determines whether the modification of the one or more light patterns is sufficient to reproduce the color of input image 701. Therefore, image correction processor 707 determines a color difference value from a predicted color value for a subpixel, as generated by pixel predictor 709, and an expected value representing the color for a corresponding portion (e.g., a subpixel or pixel) of input image 701. If the color difference value is outside of a range of color difference values, then the color difference may be perceptible to the human visual system. Thus, image correction processor 707 can adjust the color difference from a first magnitude (e.g., a non-compliant value) to the color difference of a second magnitude (e.g., a compliant value) based an amount of the color difference, and optionally based only other factors to determine the relative severity (or magnitude) of a color difference (e.g., a perceptible color difference), as discussed with FIGS. 4, 5, and/or 6. In some embodiments, image correction processor 707 operates reiteratively to determine an optimal modification of the illuminants to reduce delta E. In various embodiments, image correction processor 707 determines color differences using delta E computations. Once image correction processor 707 determines pixel values for a subpixel having its color corrected, image correction processor 707 generates front modulator data signals 750 and back modulator signals 752. Front modulator data signals 750 can be generated by dividing data representing input image 701 with luminance values of a light pattern that has been modified to reduce or eliminate the perceptibility of an artifact (e.g., by modifying blue backlight). In some embodiments, front modulator data signals 750 and back modulator signals 752 can be generated from one frame and can be applied to a subsequent frame.

In some embodiments in which luminance values are to be preserved, then image correction processor 707 determines a range of backlight that will allow a desired luminance value to be achieved, and then controls a number of subpixels to achieve the desired result. In some embodiments, image correction processor 707 uses predetermined criteria or parameters to guide the color modification process to resolve an artifact. For example, the predetermined criteria or parameters can be based on human visual system factors or empirical research. As another example, it may be determined that, for a given luminance range, a preservation of the R:G:B ratio for a subpixel can produce a lower delta E than preserving the luminance value exactly. In this case, image correction processor 707 determines the luminance of a pixel, as well as the color of the pixel, while omitting a delta E calculation. In some embodiments, an absolute luminance that a pixel can emit for a given RGB drive value may depend on a display system (e.g., display characteristics). In some cases, the absolute luminance is determinable through metadata about the display system to be used in, for example, executable instructions constituting an image processor or a portion thereof. Alternatively, relative values may be used, or approximations for display luminance calibration metadata may be used. In some embodiments, a subpixel generates a pure primary color, such as a green-magenta color filter using red, green, and blue backlight. The pure primary color element, such as the green color filter, serves as a control to preserve luminance and/or pixel ratio. For example, the red and blue channels compete for magenta pixels in the green-magenta color filter, while the green channel is used, for example, to either preserve the luminance at that pixel or to preserve either the R:G or B:G ratios. If all three ratios are desired to be preserved, either the red or blue subpixels can be changed to preserve the R:B ratio, and then the green channel may be changed to compensate.

Figure 7B:
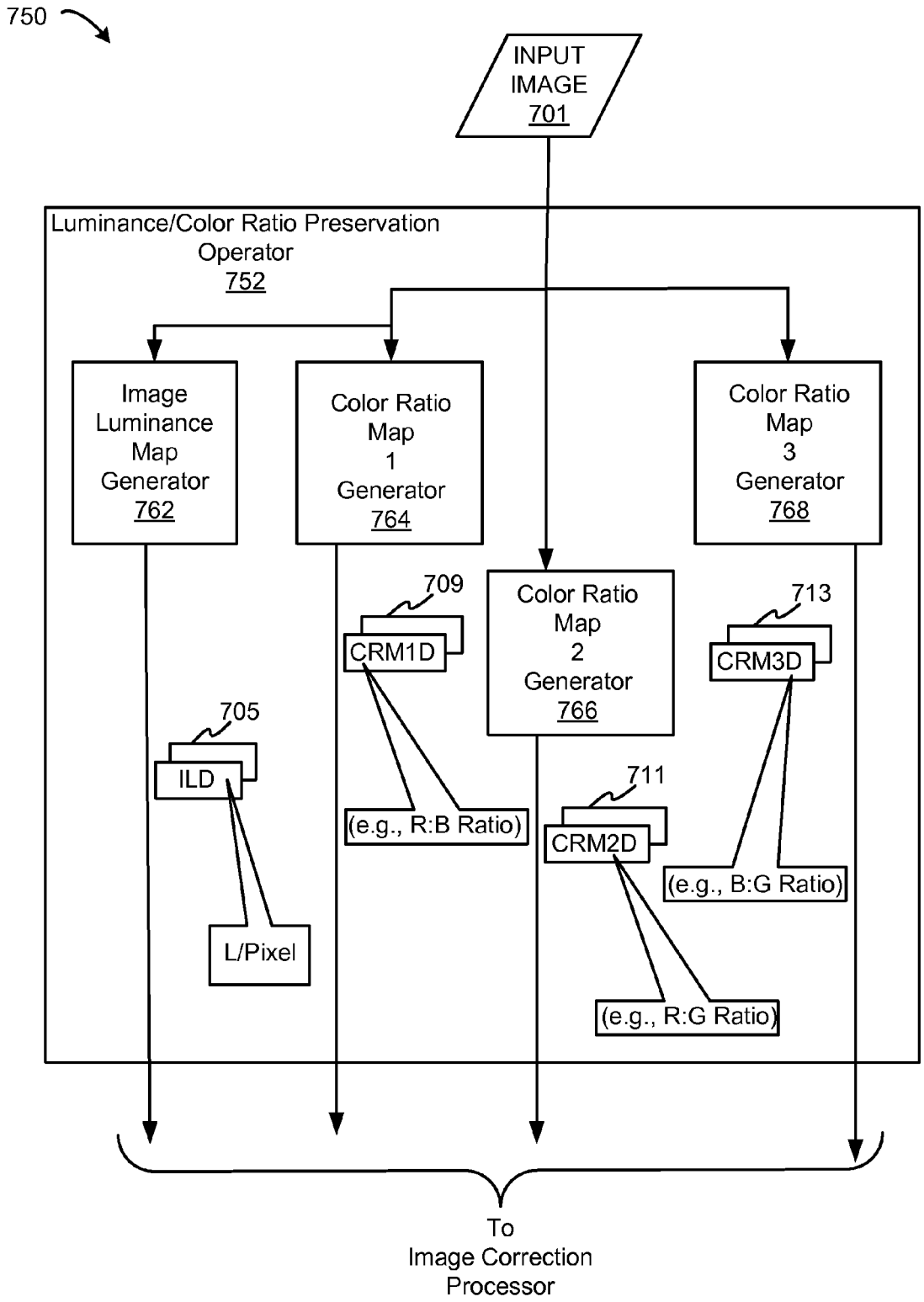
FIG. 7B depicts an example of a luminance/color ratio preservation operator, according to some embodiments of the invention.

FIG. 7B depicts an example of a luminance/color ratio preservation operator, according to some embodiments of the invention. Luminance/color ratio preservation operator 752 is configured to preserve the original image luminance values and/or preserve the original image color ratio values. These luminance values and color ratio values are used to reduce a color difference between colors that other might be perceptible to the human visual system. In some embodiments, luminance values and/or color ratio values are used to determine a delta E to confirm whether the modifications of backlight or subpixel modulation can provide a reproduced color. As shown in diagram 750, a luminance/color ratio preservation operator 752 can include an image luminance map generator 762, a color ratio map ("1") generator 764, a color ratio map ("2") generator 766, and a color ratio map ("3") generator 768.

Image luminance map generator 762 can be configured to generate a luminance map of input image 701 based on image data in any color space and in any suitable manner. For example, image luminance map data ("ILD") 705 can be generated from pixel values (e.g., RGB pixel values), with photopic ratios being applied to match the sensitivity of the human visual system for red, green, and blue light. In some embodiments, image luminance map data 705 can be generated for each subpixel, pixel, or group of pixels. Color ratio map ("1") generator 764, color ratio map ("2") generator 766, and color ratio map ("3") generator 768 can generate respectively color ratio maps (e.g., normalized color ratio maps) including the Red to Blue ("R:B") pixel values, the Red to Green ("R:G") pixel values, and the Blue to Green ("B:G") pixel values. Color ratio map ("1") generator 764, color ratio map ("2") generator 766, and color ratio map ("3") generator 768 can generate color ratio data ("CRM1D") 709, color ratio data ("CRM2D") 711, and color ratio data ("CRM3D") 713.

FIGS. 8A to 8D are diagrams that depict artifacts for which a three dimensional color synthesizer can be configured to address, according to some embodiments of the invention. In the following diagrams in FIGS. 8A to 8D, subpixels can generate any primary color using a pixel mosaic with green-magenta color filters, and using red, green, and blue backlight. Diagram 811 depicts image portion 802*a* that includes two image features, which, in turn, include a blue color 804 and a red color 808, both of which form a boundary 806. Region 805 includes subpixels that are configured to pass both red and blue light, thereby creating magenta light. With a green-magenta pixel mosaic, red and blue light pattern portions can compete for transmission by subpixels in pixel 812, while green light can be accurately modulated. Pixels 810 and pixels 814 are configured to modulate correctly for blue light and red light, respectively. Because of this, at blue versus red color boundaries, when a backlight element happens to fall behind such a boundary, its light can be shared between the red region and the blue region, both of which contribute illuminant to magenta modulators. One approach to resolving the artifact of blue and red colors blurring together is to increase the backlight resolution for one or both of these colors so that the boundary can have a sharper edge, leading to fewer errors for opposing color boundary. In another approach, as described in various embodiments herein, a three dimensional color synthesizers can be configured to modify backlight and/or front modulator transmissivity to reduce or eliminate color difference (e.g., delta E) with an input image.

Figure 8A:
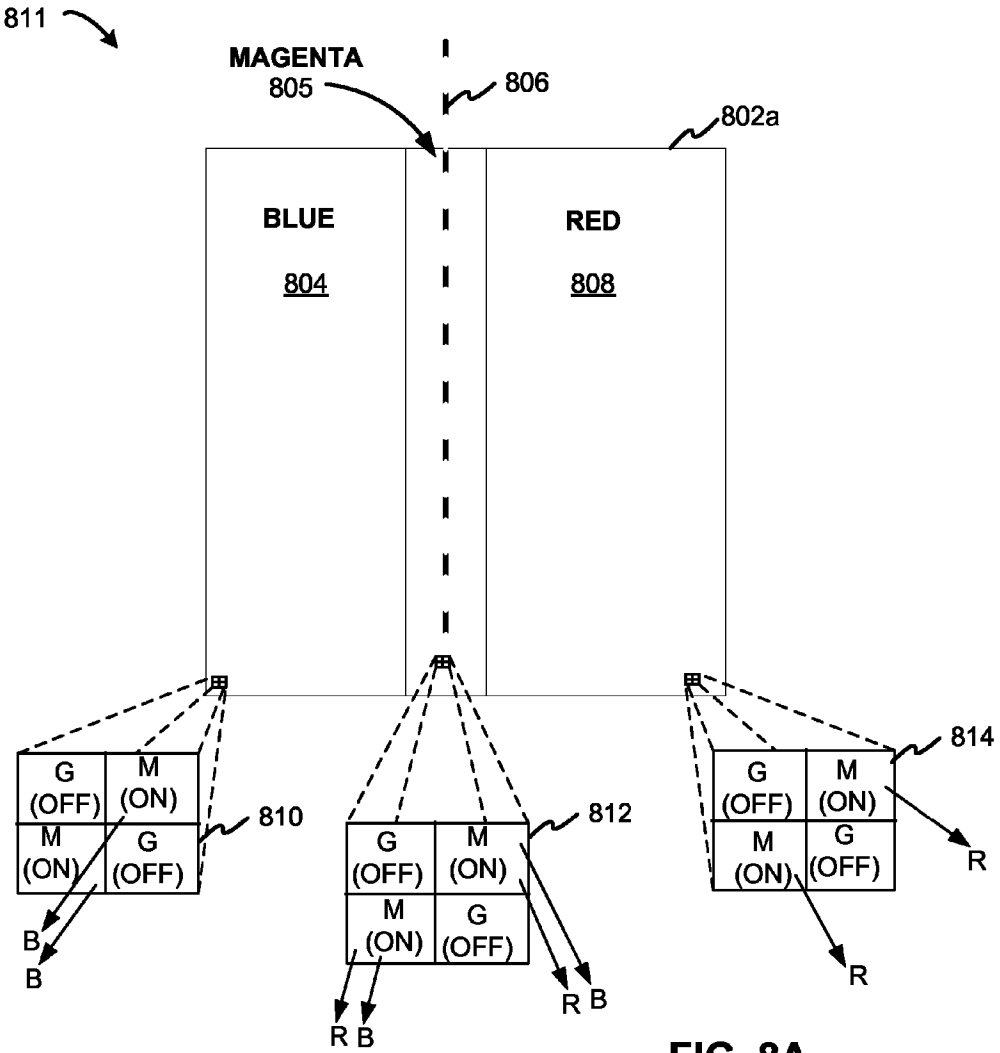
FIGS. 8A to 8D are diagrams that depict artifacts for which a three dimensional color synthesizer can be configured to address, according to some embodiments of the invention.
Figure 8B:
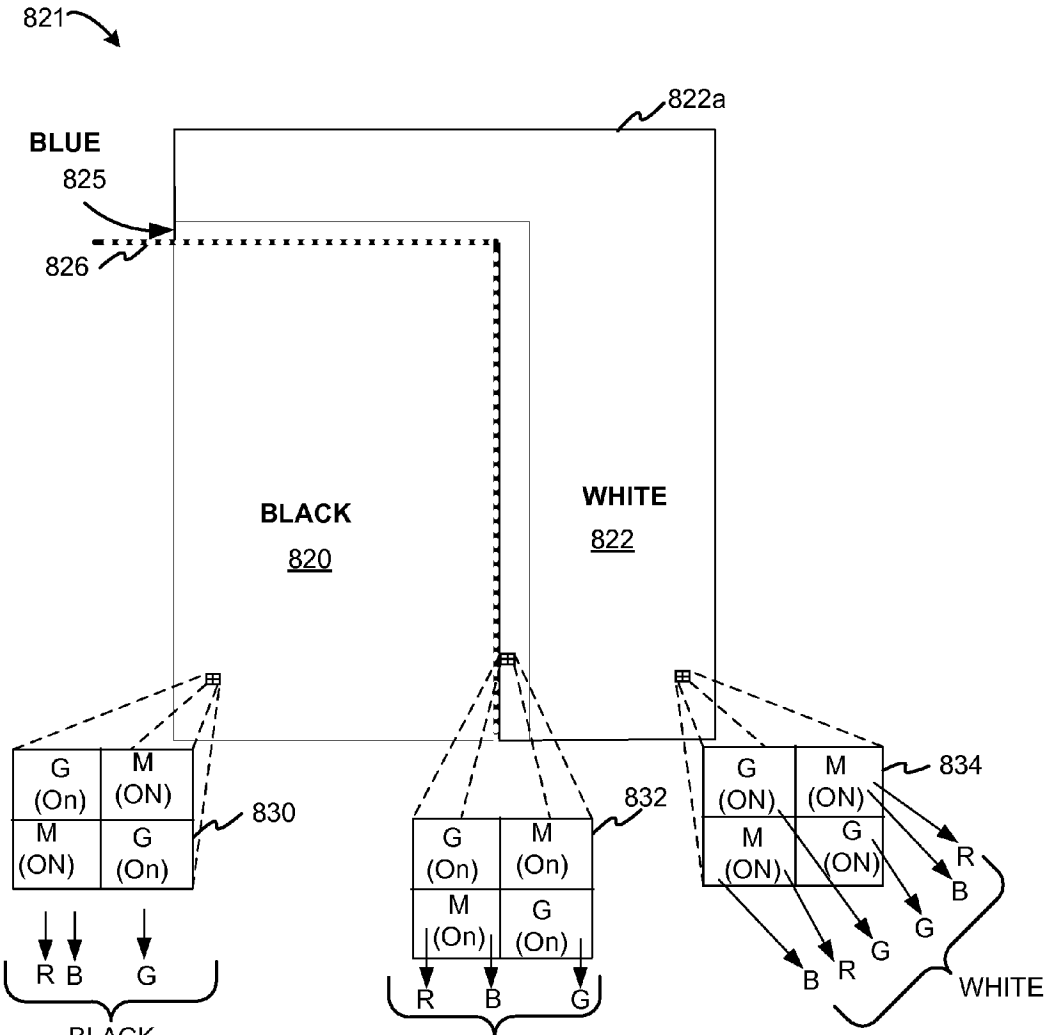

In FIG. 8B, diagram 821 depicts image portions 822*a* that includes two image features that include a dark area 820 and a light area 822, both of which form a boundary 826. With a green-magenta pixel mosaic, red and blue light pattern portions can compete for transmission by subpixels in pixel 832, while green light can be accurately modulated. Pixels 830 and pixels 834 are configured to modulate correctly for very low levels of red, blue and green light (i.e., to create the black color) and very high levels of red, blue and green light (i.e., to create the white color), respectively. Because of this, regions adjacent to the boundary between a dark area and a light area can include color fringing when a backlight element falls behind such a boundary. Therefore, the backlight can be shared between the red region and the blue region, both of which can be controlled using magenta modulators. In this example, region 825 includes a blue color fringing into white feature 822. Consider the following example in which such a region 825 can be formed. Dark area 820 can have an RGB value in the input image of RGB=15, 10, 20 to generate a very low lit area (e.g., a black color). In this example, photopic ratios can be selected to be: R:G:B=0.299:0.587:0.114. Given these photopic ratios, a color prioritizer can select red as a more important color than blue. But, since the blue has the highest RGB pixel value, the blue color can be driven at a degree higher in the backlight to preserve the color blue, which, in turn, leads to an excess of blue in the white region. An image adjuster can predict the color difference between the blue fringe color in region 825 and the white color of feature 822, and can modify the generation of the backlight to, for example, decrease the blue illuminant to remove the excess in blue color in region 825.

Figure 8C:
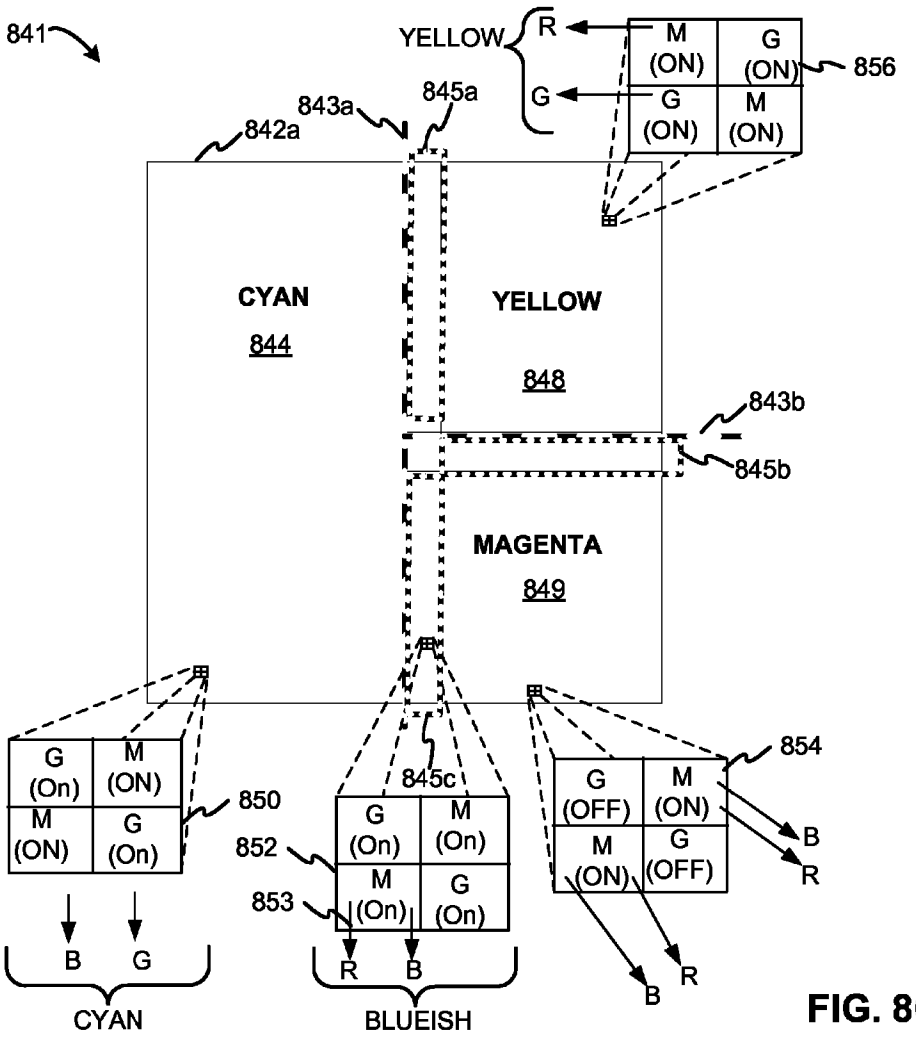

In FIG. 8C, diagram 841 depicts image portions 842*a* that includes three image features. For example, image portions 842*a* can include a cyan feature 844 and a yellow feature 848, with a boundary 843*a* disposed in between cyan feature 844 and yellow feature 848 and in between cyan feature 844 and magenta feature 849. Boundary 843*b* can be disposed between magenta feature 849 and yellow feature 848. With a green-magenta pixel mosaic, red and blue light pattern portions can compete for transmission by subpixels in pixel 852, while blue and red light are desired in pixel 854. Pixels 850 and 856 can be configured to modulate correctly for blue, green and red lights as they are sufficiently removed from boundaries 843*a* and 843*b*. Adjacent to boundaries 843*a* and 843*b* are regions 845*a*, 845*b*, and 845*c* at which color differences in the subpixels in these regions can be associated with perceptible color differences with respect to the input image.

Region 845*a* is associated with a boundary that can be characterized as a blue and non-blue color boundary. In this case, cyan feature 844 is adjacent to yellow feature 848, which produces a blue vs. non-blue boundary. The green color is modulated correctly for both feature 844 and 848. In cyan feature 844, the blue color can be determined to be the most-important-color over the color red, and in yellow feature 848, the reverse is true. The artifact in region 845*a* can be described as the red versus blue artifact. In this example, however, green light is added to generate the yellow and cyan colors. According to some embodiments, a three dimensional color synthesizer can be configured to characterize the colors of yellow and cyan to determine and predict boundary region 845*a*. An image adjuster can determine that adding red (e.g., too much red) and suppressing blue (e.g., adding too little blue) in cyan feature 844 has a lower delta E than adding blue (e.g., adding too much blue) and suppressing red (e.g., adding too little red) in yellow feature 848. An image adjuster can operate in accordance with a lower delta E so that the color of the reproduced pixels can more perceptibly match the colors of the original pixel.

Region 845*b* can be associated with a boundary of blue and non-blue colors. In this case, magenta feature 849 is adjacent to yellow feature 848, which produces a blue vs. non-blue boundary. In magenta feature 849 and yellow feature 848, the red color can be determined to be prioritized as the most-important-color in both features. Thus, the red can be correctly modulated across boundary 843*b*. In this case, the blue color of the image can be determined by the backlight control, and, as such, the magenta modulators can operate to correct for red, and a backlight can be used to compensate for the color blue. Because of the limited resolution (e.g., non-delta point spread function) of the backlight, the control of the blue color can lead to a blue deficiency in magenta feature 849 and a blue over-abundance in yellow feature 848. According to some embodiments, a three dimensional color synthesizer can be configured to characterize the colors of yellow and magenta to determine and predict boundary region 845*b*. An image adjuster can determine that adding blue (e.g., adding too much blue) in yellow feature 848 can lead to a smaller delta E than suppressing blue (e.g., adding too little blue) in magenta feature 849. An image adjuster can operate in accordance with a lower delta E so that the color of the reproduced pixels can more perceptibly match the colors of the original pixel.

Region 845*c* can be associated with a boundary of red and non-red colors that includes blue. In this case, magenta feature 849 can be adjacent to cyan feature 848, which produces a blue vs. non-blue boundary. In cyan feature 848, the blue color can be the most-important-color over the red color, and in magenta feature 849, the red color can be the most-important-color over the blue color (e.g., red can be more important than blue in magenta feature 849 due to the photopic response ratios). According to some embodiments, a three dimensional color synthesizer can be configured to can characterize the colors of cyan and magenta to determine and predict boundary region 845*c*. An image adjuster can determine that adding red (e.g., too much red) in cyan feature 844 leads to a smaller delta E than suppressing (e.g., adding too little red) in magenta feature 849. An image adjuster can operate in accordance with a lower delta E so that the color of the reproduced pixels can more perceptibly match the colors of the original pixel.

Figure 8D:
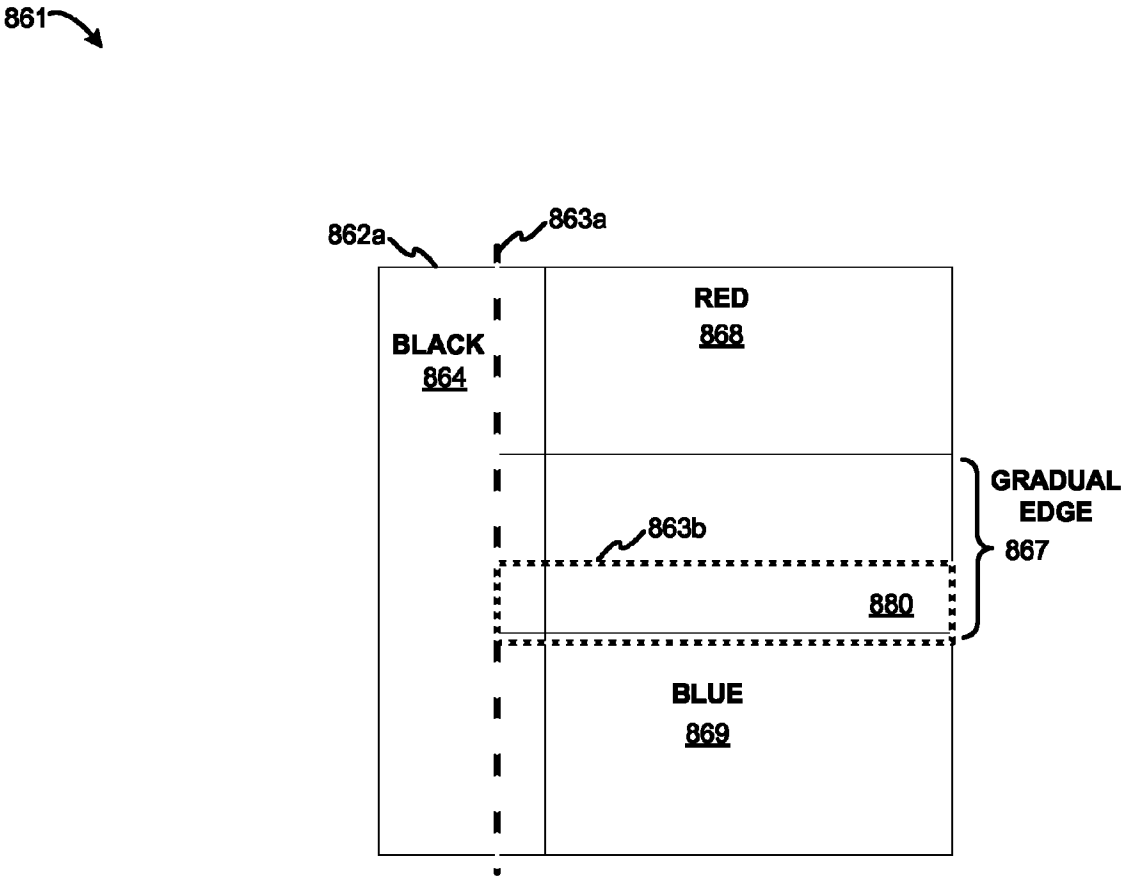

In FIG. 8D, diagram 861 depicts image portions 862*a* that includes three image features that include a dark feature 864 and a red feature 868, with a boundary 863*a* disposed in between dark feature 864 and red feature 868 and in between dark feature 864 and blue feature 869. Boundary 863*b* can be disposed between blue feature 869 and red feature 868. The artifact depicted in FIG. 8D relates to a color fade boundary. As described earlier, a most-important-color can prioritize a color for an LCD modulator to control either one color or another color, which, in this case, is either red or blue. Image areas in region 880 has a slow, low contrast transition from blue feature 849 to red feature 848, and, thus, can alternate inadvertently between red and blue, leading to relatively sharp edges in boundary 880. According to some embodiments, a three dimensional color synthesizer can be configured to characterize the colors of blue and red to characterize boundary region 880 as a gradual boundary or edge 867. Further, a three dimensional color synthesizer can be configured to blur the transition region to reduce occurrence of such artifacts. In some embodiments, an image processor can be configured to perform 3D color synthesis in a manner that reduces an effect that might otherwise occur when, for example, switching between the most-important-color (e.g., switches between two most-important colors) creates an error on either side of the boundary, which might be perceptible. For relatively slow transitions, an image processor can be configured to change gradually the prioritization of the colors to dampen a boundary so as that it can be perceived as a gradual boundary.

Figure 9:
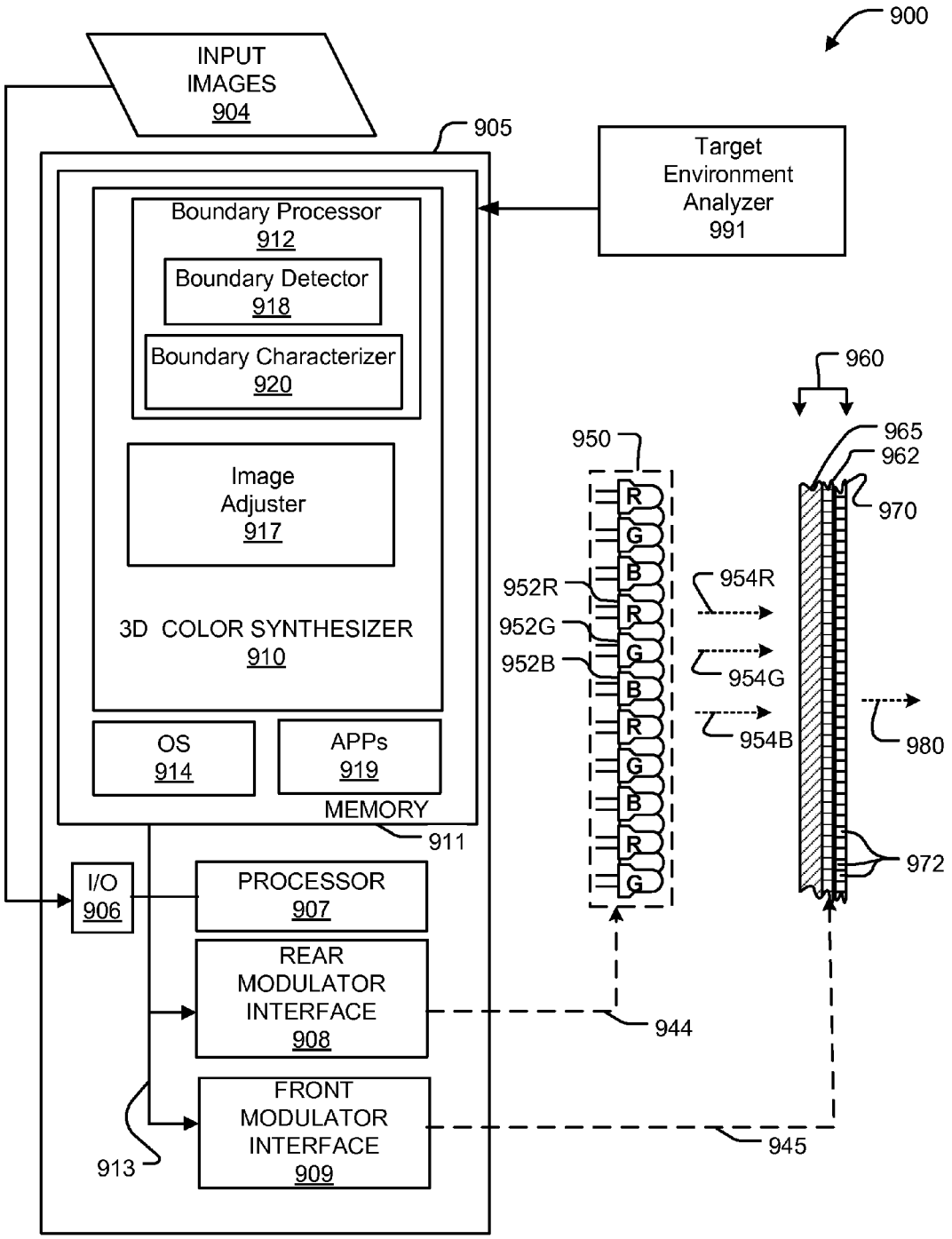
FIG. 9 is a schematic diagram of a controller configured to operate an image display system, according to at least some embodiments of the invention.

FIG. 9 is a schematic diagram of a controller configured to operate an image display system, according to at least some embodiments of the invention. Here, image display system 900 can include a controller 905 configured to be coupled to rear modulator 950 and front modulator 960. Controller 905 can include an input/output (I/O) module 906 configured to receive input images 904, a processor 907, a rear modulator interface 908 configured to control rear modulator 950, a front modulator interface 909 configured to control front modulator 960, and a memory 911. Bus 913 may couple these modules and components of controller 905 to each other, as illustrated. Processor 909 can be configured to receive input images 904. In some examples, input images 904 may be gamma-encoded video signals (e.g., video stream), from which image pixels may be derived. In other examples, input images 904 may be scaled suitably for color balance based upon certain techniques of three-dimensional color synthesis utilized. Memory 911 can include a three dimensional color synthesizer 910, which, in turn, can include boundary processor 912 and image adjuster 917. Boundary processor 912 can include a boundary detector 918 and a boundary characterizer 920. Each of these modules in memory 911 can have similar functionality as described herein. Memory 911 can also include an operating system 914 and ancillary applications 919 used to facilitate operation of controller 905, as well as more or fewer modules than shown.

Rear modulator 950 can be configured to be a light source to illuminate front modulator 960. In some examples, rear modulator 950 can be formed from one or more modulating elements 952R, 952G, and 952B, such as an array of LEDs, or one or more light sources. When controlled, either individually or in groups, modulating elements 952R, 952G, and 952B may emit light fields composed of various colors, respectively 954R, 954G, and 954B, along an optical path to illuminate front modulator 960.

Front modulator 960 may be an optical filter of programmable transparency that adjusts the transmissivity of the intensity of light incident upon it from the rear modulator 950. In some examples, front modulator 960 may comprise an LCD panel or other transmission-type light modulator having pixels. In other examples, front modulator 960 may include: optical structures 965; a liquid crystal layer with pixels 962;

and, color elements 970. Optical structures 965 may be configured to carry light from rear modulator 950 to the liquid crystal layer having pixels 962, and may include elements such as, but not limited to, open space, light diffusers, collimators, and the like. Filter 970 may include an array of color elements 972, which in some examples may each have a plurality of sub-pixel elements. Front modulator 960 may be associated with a resolution that is higher than the resolution of rear modulator 950. In some examples, front modulator 960 and rear modulator 950 may be configured to collectively operate image display system 900 as an HDR display.

Based upon input image 904, controller 905 may be configured to provide via interface 906 rear modulator drive levels (e.g., signals) over path 944 to control modulating elements, such as 952R, 952G and 952B of rear modulator 950, and may be configured to provide via interface 909 front modulator drive signals over path 945 to control pixels 962 and sub-pixels of front modulator 960, thereby collectively producing displayable images 980.

Although not shown, controller 905 may be coupled to a suitably programmed computer having software and/or hardware interfaces for controlling rear modulator 950 and front modulator 960 to produce displayable (HDR) images 980. Note that any of the elements described in FIG. 9 may be implemented in hardware, software, or a combination of these. In some embodiments, target environment analyzer 991 can be configured detect or determine characteristics of the target environment, such as the white point of a target source illuminant. For example, environment analyzer 991 can be a sensor configured to measure the viewing environment at a display, thereby facilitating automatic determination of the state of adaptation of the viewer, among other things.

FIG. 10 depicts examples of synthesizing colors based on two sub-pixel color elements and two luminance or light patterns, according to at least some embodiments of the invention.

Note that in some embodiments, a monochrome LCD can be used as front modulation elements. In some embodiments, temporal switching can be added to the various embodiments described herein to reduce the perceptibility of artifacts described herein.

The above-described methods, techniques, processes, apparatuses and computer-medium products and systems may be implemented in a variety of applications, including, but not limited to, HDR displays, displays of portable computers, digital clocks, watches, appliances, electronic devices, audio-visual devices, medical imaging systems, graphic arts, televisions, projection-type devices, and the like.

In some examples, the methods, techniques and processes described herein may be performed and/or executed by executable instructions on computer processors, for which such methods, techniques and processes may be performed. For example, one or more processors in a computer or other display controller may implement the methods describe herein by executing software instructions in a program memory accessible to a processor. Additionally, the methods, techniques and processes described herein may be implemented using a graphics processing unit ("GPU") or a control computer, or field-programmable gate array ("FPGA") or other integrated circuits coupled to the display. These methods, techniques and processes may also be provided in the form of a program product, which may comprise any medium which carries a set of computer-readable instructions which, when executed by a data processor, cause the data processor to execute such methods, techniques and/or processes. Program products, may include, but are not limited to: physical media such as magnetic data storage media, including floppy diskettes, and hard disk drives; optical data storage media including CD ROMs, and DVDs; electronic data storage media, including ROMs, flash RAM, non-volatile memories, thumb-drives, or the like; and transmission-type media, such as digital or analog communication links, virtual memory, hosted storage over a network or global computer network, and networked-servers.

In at least some examples, the structures and/or functions of any of the above-described features can be implemented in software, hardware, firmware, circuitry, or a combination thereof. Note that the structures and constituent elements above, as well as their functionality, may be aggregated with one or more other structures or elements. Alternatively, the elements and their functionality may be subdivided into constituent sub-elements, if any. As software, the above-described techniques may be implemented using various types of programming or formatting languages, frameworks, syntax, applications, protocols, objects, or techniques, including C, Objective C, C++, C#, Flex™, Fireworks®, Java™, Javascript™, AJAX, COBOL, Fortran, ADA, XML, HTML, DHTML, XHTML, HTTP, XMPP, Ruby on Rails, and others. As hardware and/or firmware, the above-described techniques may be implemented using various types of programming or integrated circuit design languages, including hardware description languages, such as any register transfer language ("RTL") configured to design field-programmable gate arrays ("FPGAs"), application-specific integrated circuits ("ASICs"), or any other type of integrated circuit. These can be varied and are not limited to the examples or descriptions provided.

Various embodiments or examples of the invention may be implemented in numerous ways, including as a system, a process, an apparatus, or a series of program instructions on a computer readable medium such as a computer readable storage medium or a computer network where the program instructions are sent over optical, electronic, or wireless communication links. In general, operations of disclosed processes may be performed in an arbitrary order, unless otherwise provided in the claims.

A detailed description of one or more examples is provided herein along with accompanying figures. The detailed description is provided in connection with such examples, but is not limited to any particular example. The scope is limited only by the claims, and numerous alternatives, modifications, and equivalents are encompassed. Numerous specific details are set forth in the description in order to provide a thorough understanding. These details are provided as examples and the described techniques may be practiced according to the claims without some or all of the accompanying details. They are not intended to be exhaustive or to limit the invention to the precise forms disclosed, as many alternatives, modifications, equivalents, and variations are possible in view of the above teachings. For clarity, technical material that is known in the technical fields related to the examples has not been described in detail to avoid unnecessarily obscuring the description.

EXAMPLES

Enumerated Example Embodiment (EEE) 1. A method to generate a reproduced image, the method comprising:

receiving into a color element of a front modulator a first colored illuminant from a first light source and a second colored illuminant from a second light source of a back modulator;

determining that the color element is configured to generate a color that has one or more color characteristics for a portion of the reproduced image; and modifying at least one of the first colored illuminant and the second colored illuminant to adjust the one or more color characteristics into a range of values associated with a portion of an image that corresponds to the portion of the reproduced image.

EEE2. The method of EEE1, further comprising:

determining that the color element is in a region associated with a boundary between groups of other color elements configured to generate different colors.

EEE3. The method of EEE1, further comprising:

determining that the color element is associated with a transition of an attribute of the reproduced image.

EEE4. The method of EEE3, wherein determining that the color element is associated with the transition of the attribute comprises:

determining that the color element is associated with a color transition.

EEE5. The method of EEE1, further comprising:

detecting a boundary between at least two groups of other color elements configured to generate reproduced image portions with different values of an attribute; and generating data identifying the boundary.

EEE6. The method of EEE5, wherein the attribute comprises either luminance or color, or both.

EEE7. The method of EEE1, further comprising:

predicting backlight for the back modulator to form data representing a predicted backlight, the predicted backlight including predicted values for the first colored illuminant and the second colored illuminant;

predicting a color value representing the color for the portion of the reproduced image to form a predicted color value based on the predicted values;

determining a value representing a color difference to form a color difference value from the predicted color value and an expected value representing the color for the portion of the image; and generating data representing an indication that the color difference value is outside a range of color difference values.

EEE8. The method of EEE7, further comprising:

determining predicted drive values configured to modify the at least one of the first colored illuminant and the second colored illuminant to adjust the color difference value into the range of color difference values.

EEE9. The method of EEE7, further comprising:

characterizing the image to generate image characterization data for the portion of the image;

predicting the reproduced image based on the predicted backlight to generate data representing a predicted image;

characterizing the predicted image to generate reproduced image characterization data for the reproduced portion of the reproduced image, the reproduced image characterization data including a characterized attribute; and modifying the characterized attribute associated with the reproduced image characterization data to adjust the color difference value into the range of color difference values.

EEE10. The method of EEE9, wherein the characterized attribute comprises either a luminance value or a color component ratio value, or both, for the portion of reproduced image.

EEE11. The method of EEE10, wherein modifying the characterized attribute comprises:

preserving the color component ratio value; and modifying the luminance value.

EEE12. The method of EEE9, further comprising:

predicting the reproduced image based on data representing viewing environment characteristics for a viewing environment associated with the front modulator.

EEE13. The method of EEE12, further comprising:

determining a state of adaption value as a viewing environment characteristic.

EEE14. The method of EEE1, further comprising:

detecting a boundary between groups of other color elements configured to generate reproduced image portions with different colors.

EEE15. The method of EEE14, wherein detecting the boundary comprises:

detecting a reciprocal change in the first colored illuminant and the second colored illuminant between a first group of color elements and a second group of color elements; and generating data representing the reciprocal change.

EEE16. The method of EEE15, further comprising:

determining an amount of change in the first colored illuminant and the second colored illuminant over a first area to validate the boundary between the different colors.

EEE17. The method of EEE15, further comprising:

determining an amount of change in the first colored illuminant and the second colored illuminant over a second area to validate that the boundary between the different colors is a gradual boundary.

EEE18. The method of EEE14, wherein detecting the boundary comprises:

determining a contrast ratio between the different colors; and generating data representing the contrast ratio.

EEE19. The method of EEE14, further comprising:

associating the groups of the other color elements associated with the boundary.

EEE20. The method of EEE1, wherein receiving into the color element of the front modulator further comprising:

receiving the first colored illuminant and the second colored illuminant as competing colors into one color element of two color elements, wherein the two color elements are configured to generate primary colors for a pixel.

EEE21. An apparatus for presenting an image, the apparatus comprising:

a back modulator comprising sets of light sources configured to generate light patterns each having different spectral distributions;

a front modulator comprising:

an arrangement of subpixels each composed of two types of color elements, at least one subpixel oriented to transmit simultaneously portions of light patterns from two light sources; and an image processor coupled to the back modulator and the front modulator to generate a reproduced image of the image, the image processor being configured to detect that the one subpixel is configured to transmit light that causes a color difference of a first magnitude with respect to a portion of the image, and being further configured to modify at least one of the light patterns from the two light sources to change the color difference to a second magnitude.

EEE22. The apparatus of EEE21, further comprising:
a boundary detector configured to detect a change of an attribute substantially at a boundary to be formed by the arrangement of subpixels.

EEE23. The apparatus of EEE22, wherein the front modulator further comprises:
a first subset of subpixels configured to modulate a first color associated with a first light pattern; and
a second subset of subpixels configured to modulate a second color associated with a second light pattern,
wherein the boundary is disposed between the first subset of subpixels and the second subset of subpixels.

EEE24. The apparatus of EEE23, further comprising:
a color prioritizer configured to specify that the first color is prioritized for modulation by first subset of subpixels, and that the second color is prioritized for modulation by second subset of subpixels.

EEE25. The apparatus of EEE22, wherein the boundary detector is further configured to detect the change of the attribute as a change in opponent values of a first color associated with a first light pattern and a second color associated with a second light pattern.

EEE26. The apparatus of EEE22, further comprising:
an image correction processor configured to:
indentify that the one subpixel is in the first subset of subpixels, the one subpixel corresponding to the portion of the image;
calculate a first color difference between the one subpixel and the portion of the image; and
modify one or more of the light patterns from the two light sources to adjust one or more color characteristics of the one subpixel so that the first color difference approaches a threshold color difference value.

EEE27. The apparatus of EEE26, wherein the image correction process is further configure to:
indentify another subpixel is in the second subset of subpixels, the another subpixel corresponding to another portion of the image;
calculate a second color difference between the another subpixel and the another portion of the image; and
modify one or more of the light patterns from the two light sources to adjust one or more color characteristics of the another subpixel so that the second color difference approaches the threshold value of color difference.

EEE28. The apparatus of EEE26, wherein the image correction process is further configure to:
indentify another subpixel is in the second subset of subpixels, the another subpixel corresponding to another portion of the image;
calculate a third color difference between the one subpixel and the another subpixel; and
modify one or more of the light patterns from the two light sources to adjust one or more color characteristics of one of the one subpixel and the another subpixel so that the other one of the one subpixel and the another subpixel sot that the third color difference approaches the threshold value of color difference.

EEE29. The apparatus of EEE22, further comprising:
a luminance/color preservation operator configured to provide luminance values and color ratios between color components for the portion of the image;
a backlight simulator configured to generate predicted light patterns for a predicted backlight; and
a pixel predictor configured to generate a predicted color based on the predicted light patterns.

EEE30. The apparatus of EEE29, further comprising:
an image correction processor configured to determine an amount with which to modify the at least one of the light patterns from the two light sources to preserve at least one of the color ratios based on the predicted color.

EEE31. The apparatus of EEE29, further comprising:
an image correction processor configured to adjust the color difference of the first magnitude to the color difference of the second magnitude based an amount of color difference.

EEE32. The apparatus of EEE29, further comprising:
an image correction processor configured to identify a type of artifact for the boundary that is associated with the color difference of the first magnitude, and further configured to adjust the color difference to the second magnitude.

EEE33. The apparatus of EEE32, wherein the type of artifact is a dark-light artifact such that a first group of subpixels on one side of the boundary are configured to transmit light associated with a low range of pixel values that include a black color, and a second group of subpixels on the other side of the boundary are configured to transmit light associated with a high range of pixel values that include a white color.

EEE34. The apparatus of EEE32, wherein the type of artifact is an opposing color artifact such that a first group of subpixels on one side of the boundary are configured to transmit light of substantially the same color as the first color, and a second group of subpixels on the other side of the boundary are configured to transmit light of substantially the same color as the second color.

EEE35. The apparatus of EEE32, further comprising:
a gradual boundary detector configured to detect that a rate of change of the attribute over the boundary indicates an incremental change between from one color to another color over an area.

EEE36. The apparatus of EEE35, further comprising:
a gradient map generator configured to provide data representing the rate of change of the attribute for the one subpixel.

EEE37. The apparatus of EEE21 wherein the back modulator comprises:
an array of red light sources, an array of green light sources, and an array of blue light sources.

EEE38. The apparatus of EEE37 wherein the light sources comprise:
light emitting diodes ("LEDs").

EEE39. The apparatus of EEE21 wherein the front modulator comprises:
an array of liquid crystal display ("LCDs") devices.

EEE40. The apparatus of EEE39 wherein the array of liquid crystal devices comprises:
active matrix LCD devices.

EEE41. A computer readable medium to generate a reproduced image, the computer readable medium comprising executable instructions configured to:
receive into a color element of a front modulator a first colored illuminant from a first light source and a second colored illuminant from a second light source of a back modulator;
determine that the color element is configured to generate a color that has one or more color characteristics for a portion of the reproduced image; and
modify at least one of the first colored light and the second colored light to adjust the one or more color characteristics into a range of values associated with a portion of an image that corresponds to the portion of the reproduced image.

EEE42. The computer readable medium of EEE41, further comprising executable instructions configured to:

determine that the color element is in a region associated with a boundary between groups of other color elements configured to generate different colors.

EEE43. The computer readable medium of EEE41, further comprising executable instructions configured to:

determine that the color element is associated with a transition of an attribute of the reproduced image.

EEE44. The computer readable medium of EEE43, wherein the executable instructions configured to determine that the color element is associated with the transition of the attribute comprises executable instructions configured to:

determine that the color element is associated with a color transition.

EEE45. The computer readable medium of EEE41, further comprising executable instructions configured to:

detect a boundary between at least two groups of other color elements configured to generate reproduced image portions with different values of an attribute; and generate data identifying the boundary.

EEE46. The computer readable medium of EEE45, wherein the attribute comprises either luminance or color, or both.

EEE47. The computer readable medium of EEE41, further comprising executable instructions configured to:

predict backlight for the back modulator to form data representing a predicted backlight, the predicted backlight including predicted values for the first colored illuminant and the second colored illuminant;

predict a color value representing the color for the portion of the reproduced image to form a predicted color value based on the predicted values;

determine a value representing a color difference to form a color difference value from the predicted color value and an expected value representing the color for the portion of the image; and generate data representing an indication that the color difference value is outside a range of color difference values.

EEE48. The computer readable medium of EEE47, further comprising executable instructions configured to:

determine predicted drive values configured to modify the at least one of the first colored light and the second colored light to adjust the color difference value into the range of color difference values.

EEE49. The computer readable medium of EEE47, further comprising executable instructions configured to:

characterize the image to generate image characterization data for the portion of the image;

predict the reproduced image based on the predicted backlight to generate data representing a predicted image;

characterize the predicted image to generate reproduced image characterization data for the reproduced portion of the reproduced image, the reproduced image characterization data including a characterized attribute; and modify the characterized attribute associated with the reproduced image characterization data to adjust the color difference value into the range of color difference values.

EEE50. The computer readable medium of EEE49, wherein the characterized attribute comprises either a luminance value or a color component ratio value, or both, for the portion of reproduced image.

The description, for purposes of explanation, uses specific nomenclature to provide a thorough understanding of the invention. However, it will be apparent that specific details are not required in order to practice the invention. In fact, this description should not be read to limit any feature or aspect of the present invention to any embodiment; rather features and aspects of one example can readily be interchanged with other examples. Notably, not every benefit described herein need be realized by each example of the present invention; rather any specific example may provide one or more of the advantages discussed above. In the claims, elements and/or operations do not imply any particular order of operation, unless explicitly stated in the claims. It is intended that the following claims and their equivalents define the scope of the invention.

What is claimed:

1. A method to generate a reproduced image in a dual modulator display system, said system comprising a processor, a front modulator, a back modulator comprising a set of backlight elements, wherein said backlight elements comprising at least a first light source and a second light source and further wherein the front modulator and the backlight elements are independently controllable by the processor in response to input image data received by the display system, the method comprising:

receiving input image data that specifies that a color element of the front modulator is to receive a first colored illuminant from the first light source and a second colored illuminant from the second light source of the back modulator;

detecting a boundary between groups of other color elements configured to generate reproduced image portions with different colors;

predicting the appearance of the image as might be reproduced by the display system; and when the predicted appearance at a detected boundary comprises mismatch attributes, modifying at least one of the first colored illuminant and the second colored illuminant under control of the processor according to input image data to adjust the one or more color characteristics into a range of values associated with a portion of an image that corresponds to the portion of the reproduced image.

2. The method of claim 1, further comprising:

determining that the color element is in a region associated with a boundary between groups of other color elements configured to generate different colors.

3. The method of claim 1, further comprising:

determining that the color element is associated with a transition of an attribute of the reproduced image.

4. The method of claim 3, wherein determining that the color element is associated with the transition of the attribute comprises:

determining that the color element is associated with a color transition.

5. The method of claim 1, further comprising:

detecting a boundary between at least two groups of other color elements configured to generate reproduced image portions with different values of an attribute; and generating data identifying the boundary.

6. The method of claim 1, further comprising:

predicting backlight for the back modulator to form data representing a predicted backlight, the predicted backlight including predicted values for the first colored illuminant and the second colored illuminant;

predicting a color value representing the color for the portion of the reproduced image to form a predicted color value based on the predicted values;

determining a value representing a color difference to form a color difference value from the predicted color value and an expected value representing the color for the portion of the image; and generating data representing an indication that the color difference value is outside a range of color difference values.

7. The method of claim 6, further comprising:

determining predicted drive values configured to modify the at least one of the first colored illuminant and the second colored illuminant to adjust the color difference value into the range of color difference values.

8. The method of claim 6, further comprising:

characterizing the image to generate image characterization data for the portion of the image;

predicting the reproduced image based on the predicted backlight to generate data representing a predicted image;

characterizing the predicted image to generate reproduced image characterization data for the reproduced portion of the reproduced image, the reproduced image characterization data including a characterized attribute; and modifying the characterized attribute associated with the reproduced image characterization data to adjust the color difference value into the range of color difference values.

9. The method of claim 8, wherein the characterized attribute comprises either a luminance value or a color component ratio value, or both, for the portion of reproduced image.

10. The method of claim 9, wherein modifying the characterized attribute comprises:

preserving the color component ratio value; and modifying the luminance value.

11. The method of claim 1, wherein detecting the boundary comprises:

determining a contrast ratio between the different colors; and generating data representing the contrast ratio.

12. An apparatus for presenting an image, the apparatus comprising:

a back modulator comprising sets of light sources configured to generate light patterns each having different spectral distributions;

a front modulator comprising:

an arrangement of subpixels each composed of two types of color elements, at least one subpixel oriented to transmit simultaneously portions of light patterns from two light sources; and an image processor coupled to the back modulator and the front modulator to generate a reproduced image of the image by controlling the back modulator and the front modulator according to input image data received by the apparatus, the image processor being configured to:

receive input image that that specifies that a color element of the front modulator is to receive a first colored illuminant from the first light source and a second colored illuminant from the second light source of the back modulator;

detecting a boundary between groups of other color elements configured to generate reproduced image portions with different colors;

predicting the appearance of the image as might be reproduced by the display system; and when the predicted appearance at a detected boundary comprises mismatch attributes, modifying at least one of the first colored illuminant and the second colored illuminant under control of the processor according to input image data to adjust the one or more color characteristics into a range of values associated with a portion of an image that corresponds to the portion of the reproduced image.

13. The apparatus of claim 12, further comprising:

a boundary detector configured to detect a change of an attribute substantially at a boundary to be formed by the arrangement of subpixels.

14. The apparatus of claim 13, wherein the front modulator further comprises:

a first subset of subpixels configured to modulate a first color associated with a first light pattern; and a second subset of subpixels configured to modulate a second color associated with a second light pattern, wherein the boundary is disposed between the first subset of subpixels and the second subset of subpixels.

15. The apparatus of claim 13, further comprising:

an image correction processor configured to:

identify that the one subpixel is in the first subset of subpixels, the one subpixel corresponding to the portion of the image;

calculate a first color difference between the one subpixel and the portion of the image; and modify one or more of the light patterns from the two light sources to adjust one or more color characteristics of the one subpixel so that the first color difference approaches a threshold color difference value.

16. The apparatus of claim 15, wherein the image correction process is further configured to:

identify another subpixel is in the second subset of subpixels, the another subpixel corresponding to another portion of the image;

calculate a second color difference between the another subpixel and the another portion of the image; and modify one or more of the light patterns from the two light sources to adjust one or more color characteristics of the another subpixel so that the second color difference approaches the threshold value of color difference.

17. The apparatus of claim 15, wherein the image correction process is further configured to:

identify another subpixel is in the second subset of subpixels, the another subpixel corresponding to another portion of the image;

calculate a third color difference between the one subpixel and the another subpixel; and modify one or more of the light patterns from the two light sources to adjust one or more color characteristics of one of the one subpixel and the another subpixel so that the other one of the one subpixel and the another subpixel sot that the third color difference approaches the threshold value of color difference.

18. The apparatus of claim 13, further comprising:

a luminance/color preservation operator configured to provide luminance values and color ratios between color components for the portion of the image;

a backlight simulator configured to generate predicted light patterns for a predicted backlight; and a pixel predictor configured to generate a predicted color based on the predicted light patterns.

19. The apparatus of claim 18, further comprising:

an image correction processor configured to identify a type of artifact for the boundary that is associated with the color difference of the first magnitude, and further configured to adjust the color difference to the second magnitude.

20. The apparatus of claim 19, wherein the type of artifact is a dark-light artifact such that a first group of subpixels on one side of the boundary are configured to transmit light associated with a low range of pixel values that include a black color, and a second group of subpixels on the other side of the boundary are configured to transmit light associated with a high range of pixel values that include a white color.

21. The apparatus of claim 19, wherein the type of artifact is an opposing color artifact such that a first group of subpixels on one side of the boundary are configured to transmit light of substantially the same color as the first color, and a second group of subpixels on the other side of the boundary are configured to transmit light of substantially the same color as the second color.

22. The apparatus of claim 19, further comprising:

a gradual boundary detector configured to detect that a rate of change of the attribute over the boundary indicates an incremental change between from one color to another color over an area.

* * * * *